US008638959B1

(12) United States Patent
Hall

(10) Patent No.: US 8,638,959 B1
(45) Date of Patent: Jan. 28, 2014

(54) REDUCED ACOUSTIC SIGNATURE LOUDSPEAKER (RSL)

(71) Applicant: Loring C. Hall, Spring, TX (US)

(72) Inventor: Loring C. Hall, Spring, TX (US)

(73) Assignee: Loring C. Hall, Spring, TX (US)

( * ) Notice: Subject to any disclaimer, the term of this patent is extended or adjusted under 35 U.S.C. 154(b) by 0 days.

(21) Appl. No.: 13/646,883

(22) Filed: Oct. 8, 2012

(51) Int. Cl.
*H04R 5/02* (2006.01)

(52) U.S. Cl.
USPC ..... 381/307; 381/160

(58) Field of Classification Search
USPC ..... 381/387, 186, 307, 160; 181/156
See application file for complete search history.

(56) References Cited

U.S. PATENT DOCUMENTS

| | | | | | |
|---|---|---|---|---|---|
| 3,592,290 | A * | 7/1971 | Armstrong | 181/151 |
| 3,627,948 | A * | 12/1971 | Nichols | 381/303 |
| 5,199,075 | A * | 3/1993 | Fosgate | 381/307 |
| 5,286,928 | A * | 2/1994 | Borland | 181/153 |
| 5,450,495 | A * | 9/1995 | Goldfarb | 381/89 |
| 6,079,515 | A * | 6/2000 | Newman | 181/156 |
| 6,169,811 | B1 * | 1/2001 | Croft, III | 381/186 |
| 6,364,390 | B1 * | 4/2002 | Finneman | 296/37.7 |
| 8,155,370 | B2 * | 4/2012 | Hsu et al. | 381/387 |
| 2004/0020711 | A1 * | 2/2004 | China | 181/176 |
| 2005/0139413 | A1 * | 6/2005 | Sleboda et al. | 181/150 |
| 2006/0222191 | A1 * | 10/2006 | Hung et al. | 381/307 |

* cited by examiner

*Primary Examiner* — Davetta W Goins
*Assistant Examiner* — Amir Etesam
(74) *Attorney, Agent, or Firm* — Conley Rose

(57) ABSTRACT

A reduced acoustic signature loudspeaker system includes left and right loudspeaker assemblies that include cabinets having a plurality of sides. A full range acoustic driver/array is mounted to the first side and facing a side wall of a listening space, the second side forms the rear of the loudspeaker assembly to which is mounted a set of input terminals. The full range on-axis directional acoustic output of each loudspeaker assembly is directed outward toward the left and right side walls respectively of the listening space at an azimuth of approximately 180+/−45 degrees. No acoustic output of the loud speaker system is directed toward the listening space or directed vertically, up or down and the first sides of the left and right loud speaker assemblies are separated by a distance of at least approximately 1.0 feet.

26 Claims, 27 Drawing Sheets

400

410

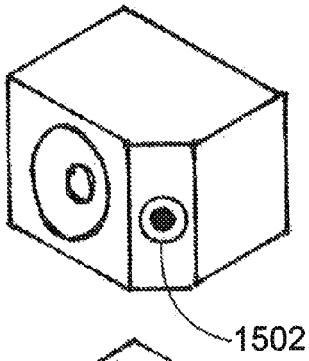
FIG 15a
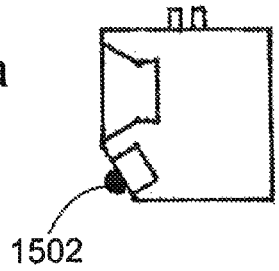
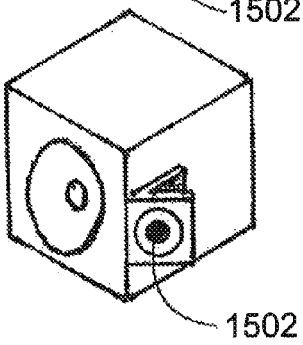
FIG 15b
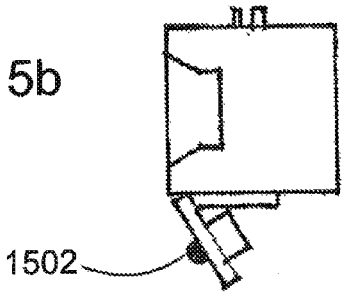
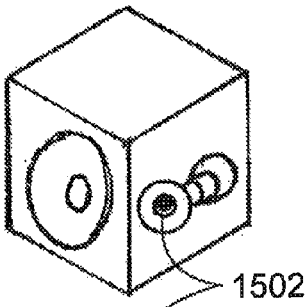
FIG 15c
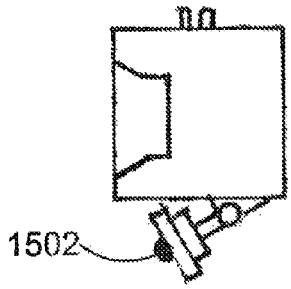
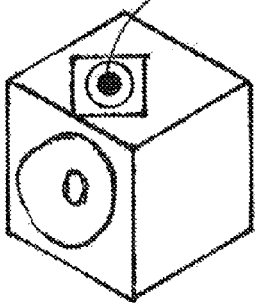
FIG 15d
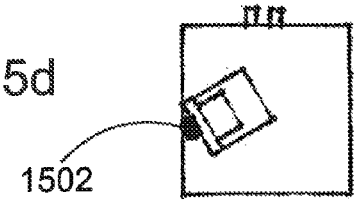

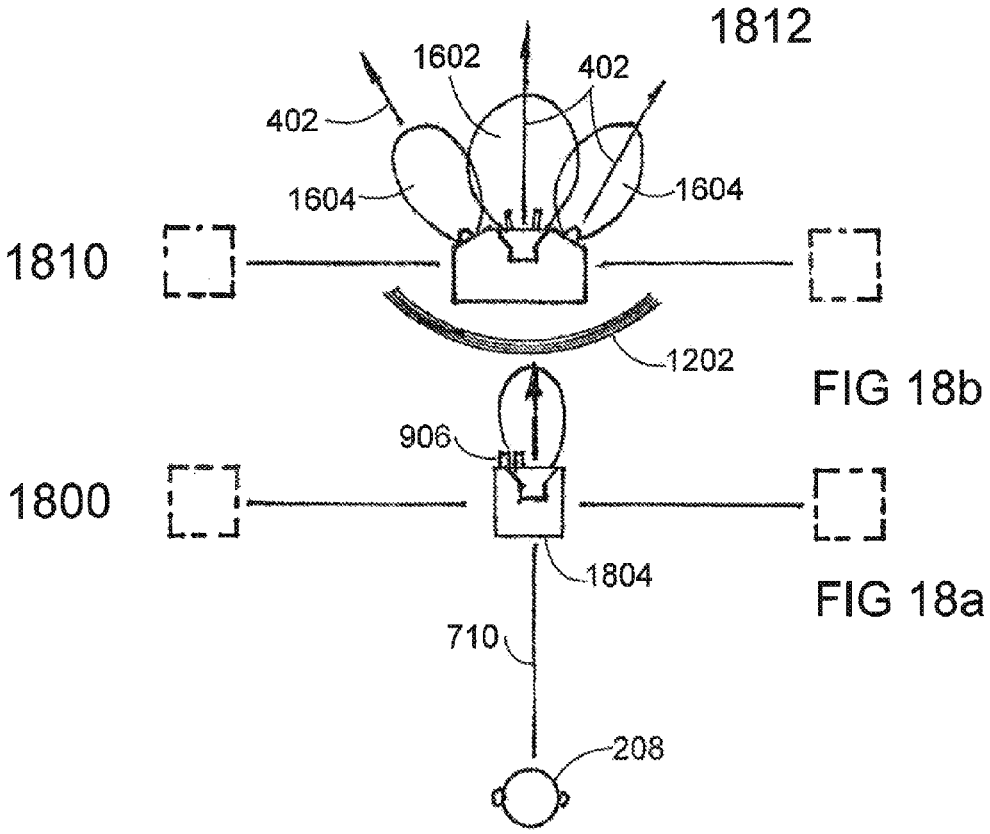
FIG 18b
FIG 18a
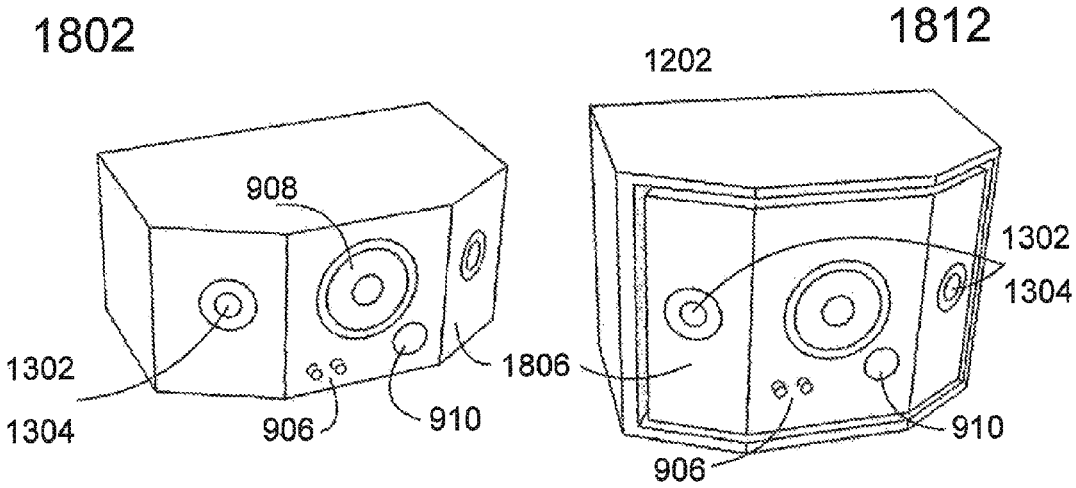
FIG 18 c
FIG 18d

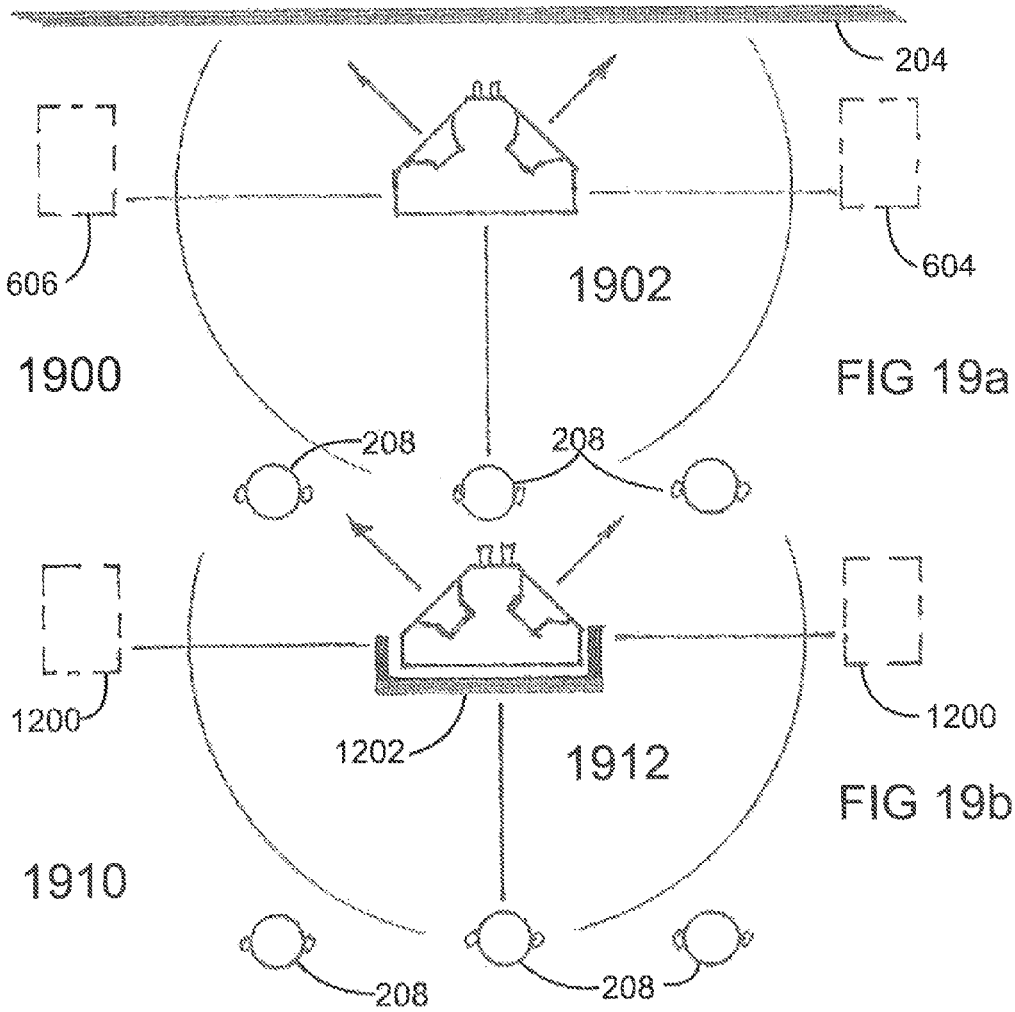
FIG 19a
FIG 19b
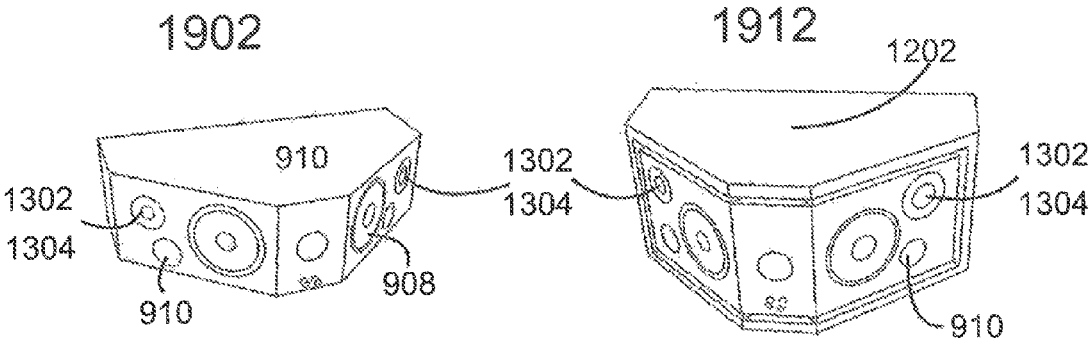
FIG 19c
FIG 19d

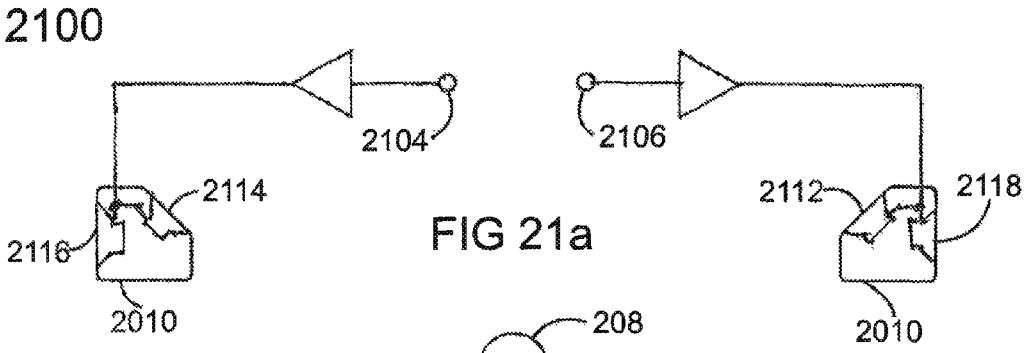
FIG 21a
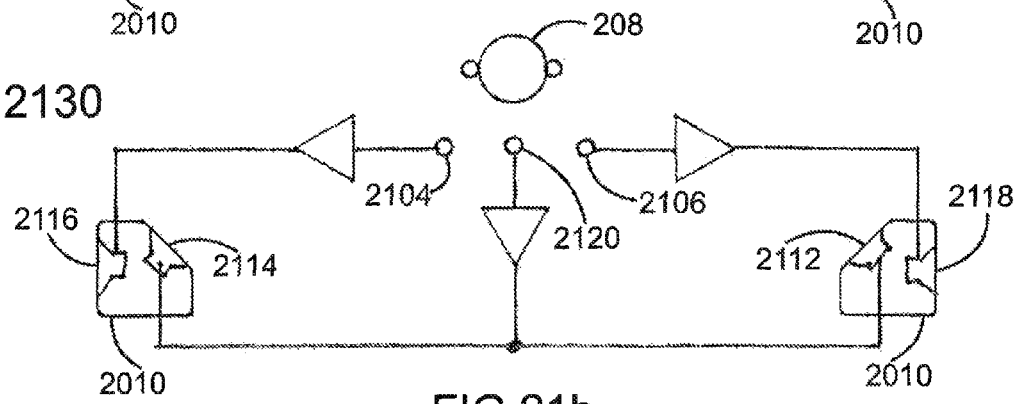
FIG 21b
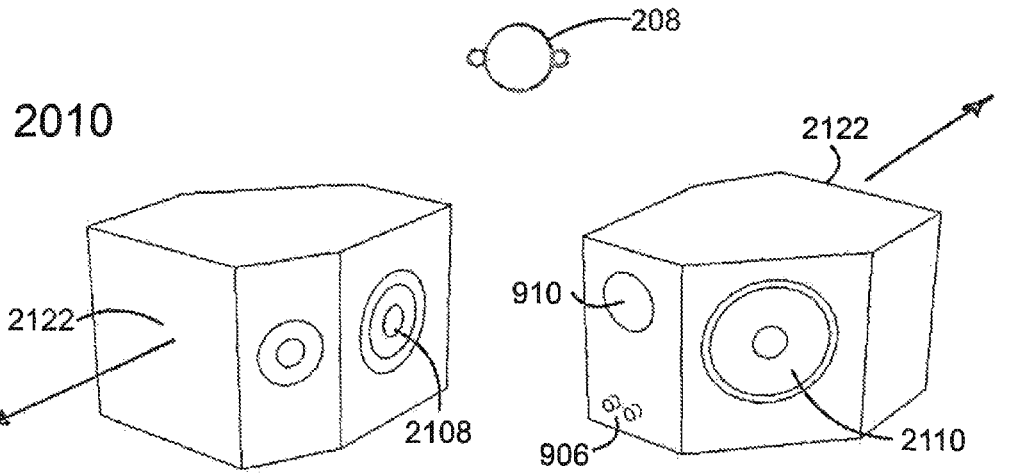
FIG 21c
FIG 21d

REDUCED ACOUSTIC SIGNATURE LOUDSPEAKER (RSL)

BACKGROUND OF THE INVENTION

The human sense of hearing is a sensitive system that relies on a series of overlapping queues that allow the listener to gain accurate insight to its environment as well as to identify the direction of sounds. Sound sources generate a set of acoustic cues, that is, sound sources have an acoustic signature, which the human sense of hearing analyzes differentially to localize these sound sources. Current art loudspeaker systems provide a high acoustic signature that the human sense of hearing will use to localize sound at the loudspeaker. This is a problem for audio and video sound systems that are designed to sonically "fool" the human hearing system into thinking that it is an environment other than where the listener actually is.

The human sense of hearing relies on three primary acoustic cues. The first acoustic cue is the interaural amplitude difference ("IID"), or the difference in amplitude. The amplitude or intensity of a sound will be greatest at the ear closest to the sound source. As a result sounds to the left will have a greater intensity in the left ear than the right ear and sounds coming from directly in front or back of a listener will be of equal intensity. These IIDs are most effective at frequencies nominally above 700 Hz where the acoustical wavelength is shorter than the human head. These amplitude differences are the result of the head casting an acoustic shadow over the far or opposite ear.

The second primary acoustic cue is the interaural phase or time difference ("ITD"), which is a result of the amount of time required for sound to reach each ear. The ear closest to the sound source receives the sound first and as a result the sound is perceived to be closer to that ear. Sound emanating from directly ahead arrives at the same time and will therefore be perceived to be directly ahead of the listener. The differential in arrival time predominates at frequencies nominally below 700 Hz where the acoustical wavelength is relatively long compared to the size of the listener's head. At frequencies below a nominal 150 Hz the sound becomes non-directional.

The third primary cue is the Head Related Impulse Response (HRIR) commonly expressed as the Head Related Transfer Function (HRTF). HRTF describes how a given sound wave input is filtered by the diffraction and reflection properties of the head, pima, and torso, before the sound reaches the eardrum and inner ear. Since each individual listener has a unique pinna, torso, and other physiological features that further modify the information presented to the sense of hearing. These listener-specific differences are referred to as the HRTF.

As sound increases in frequency its wavelength decreases. Sounds having a frequency above a nominal 700 Hz are increasingly blocked or shadowed by the head to the opposite ear while frequencies lower than a nominal 700 Hz are heard at equal intensity at both ears such that temporal or phase cues become dominant. As a result, the human sense of hearing relies on intensity cues for higher pitch sounds and temporal cues for lower pitch sounds, while HRTF cues are functions of essentially all audible frequencies with prior research indicating the range from 500 Hz to 4000 Hz to be most significant FIG. 1 shows the spectral relationships of the three primary listening cues. The ITD cue 100 is dominant in the frequency range defined at the upper frequency where one wave length equals the width of the typical human head (nominally 2000 Hz) and at the lower frequencies where sound becomes non-directional (nominally 150 Hz). The IID cue 102 begins at about 700 Hz and becomes dominant through the upper frequencies to the threshold of hearing at 20,000 Hz. HRTF cues 104 influence localization principally from about 400 Hz and above.

The human sense of hearing uses the entire audible frequency range to localize sounds as detailed above. Additionally, the ITD cue determines direction when presented with conflicting directional cues; however direction is determined by intensity and HRTF cues when the low-frequency stimuli are removed. Thus, the sense of hearing is actually looking for the best match of the three primary cues, amplitude, phase, and HRTF, to accurately localize sound sources. In addition, the Precedence Effect or the Law of the First Wave Front states that similar sounds arriving from different locations are solely localized in the direction of the first sound arriving at the listener's ears, while later sounds, typically reflections and echoes, are ignored by the listener.

In addition to the primary localization cues the sense of hearing utilizes additional methods to improve localization in more difficult and potentially confusing environments. These techniques also complicate the reproduction of sound.

As explained above, when similar transient signals are perceived by the sense of hearing, the sense of hearing tends to localize by using only the leading edge of the transient. As an example, it is usually not difficult to localize a sound source in a reverberant room because the direct sound is received before the room reflections. The Law of the First Wave suggests that sound will reach a listener over a direct path followed by reflected sound; this is particularly true in a smaller room like those where a home audio and/or video system ("A/V system") may operate. That sound arriving at the listener first creates the primary perception of direction.

The Precedence Effect describes how the sense of hearing will integrate reflections within nominally the first 50 milliseconds and combine them to give the impression that all the sound is coming from the initial source. This is similar to how the human sense of sight integrates the procession of still images into the sense we are watching a moving picture, provided that the still images are presented at a sufficient rate. In a typical listening room, loudspeakers are usually less than 12 feet from the listener(s), which equates to a transit time of about 10 milliseconds, which is shorter than the echo threshold. The Precedence Effect describes how the reflections that follow the first wave front are combined to give an increased sense of intensity.

As explained above, each individual listener has a unique HRTF. As a result, any single sonic event is perceived similarly by a number of listeners, but the actual information arriving at the inner ear will be different and is specific to each listener. In a prior art stereo system, the HRTF cues generated by the loudspeaker match the IID and ITD cues allowing the human sense of hearing to precisely locate the loudspeaker. This makes it difficult to fool the human sense of hearing into believing that the reproduced sound is not from loudspeakers.

FIG. 2 shows the temporal relationship between acoustic reflections and the first wave, or the direct sound, that initiates localization. When a sound is emitted from a source 200, propagation occurs in a spherical manner until the first wave 202 strikes a surface 204. This surface 204 causes the sound waves to be reflected as reflected waves 206. In a typical listening room, the portion of the first wave 202 that is moving toward a listener 208 will lead these reflected waves, causing the first wave 202 to initiate localization in the listener's 208 sense of hearing according to the Law of the First Wave/Precedence Effect. The arrival of reflected sound will always lag the First Wave Front of direct sound. In a sound reproduction system, early reflections of sound off room surfaces will serve as a sound level reinforcement as we know from the Precedence Effect.

An energy time curve (ETC) is a plot of amplitude in decibels against time and shows how sound energy decays in a space. Energy Time measurements are used in room and venue design to control acoustic reflections. Energy Time Curves can be utilized to better understand how the human sense of hearing uses time in the perception of an acoustic environment. How the time evolution of sound energy builds up in a room or venue is important since it is the energy in the sound that is critical for perception.

The generalized Energy Time Curve 300 shown in FIG. 3*a* illustrates the timing of direct and reflective sound waves. A sound generated at time $t_0$ is propagated into the space reaching a microphone or listener at $t_1$ on the first wave and is referred to as direct sound followed by early reflections shown at $t_2$ with reverberation trailing at $t_3$. In larger spaces, usually venues, reverberation is a factor, not so in small rooms where early reflections are typically shorter than 20 milliseconds. The length of time shown as ITD is the length of time between the direct sound and first reflections. The ITD gives listeners a sense of the characteristics of the space be it a cave, outdoors or a concert hall.

FIG. 3*b* is representative of an actual room measurement. This energy time curve 302 shows the level of reflections relative to the direct sound and the time it takes for sound to decay within the room. At time zero on the time axis, and the highest peak on the magnitude axis, represents the direct sound from the speaker. This plot shows how level changes over time, each peak is due to a reflection from a nearby boundary such as the floor, ceiling or side walls and clearly shows that there are a large number of reflections in a typical listening room and that sound does not always decay evenly.

The aim of stereophonic sound is to produce a three-dimensional illusion or a solid sonic illusion of the original sonic event. This ideal has been reduced by the IID, ITD, and HRTF cues generated by the right and left loudspeakers that localize the source of sound as coming from the loudspeaker. These cues are referred to as loudspeaker crosstalk and are an underlying reason for the dissatisfaction in the ability of prior art systems to generate stereophonic sound.

The prior stereo (i.e., two-channel) art requires two loudspeakers, left and right, driven by two independent electrical signals that represent the original sound. The right and left signals are the result of a recording process that ranges from a simple two microphone set up to elaborate multiple microphone arrays that are mixed together to create the final two channels. The left and right audio signals that are presented to each loudspeaker are composed of a combination of handed and center audio information. The result is that the handed information sounds as if it is coming from between center to either the left or right speaker and the centered information appears as a phantom image. The fact that both intensity and phase are equal for the centered information is the psychoacoustic mechanism that allows the phantom center image to be perceived. However, the listener must be on or very near to the centerline between the two speakers to perceive the center image. Furthermore, the recording microphones must have been coincident.

This arrangement, patented by Allen Blumlein in British Patent Specification No. 394325 and later referred to as "stereophonic sound," improved upon single speaker monaural systems. However, "stereophonic sound" has its limitations. Serious frequency dependant comb filtering occurs due to the confluence of identical or high correlated center signals and, ideally, coincident microphones must be used to avoid recording phase differences. Additionally, utilizing recording techniques such as a middle/side shuffler circuit may be beneficial. Further, the stereo image will be located between, and not beyond, the loudspeakers and HRTF distortion will frequently occur because the loudspeaker HRTF cues rarely match those of the original venue. These requirements lead to localization smearing or collapse of the stereo effect. Current mult-channel or home theater systems can mitigate some of these problems but at great cost, complexity, and space requirements while exacerbating other problems.

The most serious problem with stereophonic sound is that it has proven to be very difficult to set up in the home due to the requirement that the "Stereo Triangle" be adhered to for the effect to be realized. The relationship between the positioning of the loudspeakers and the listener are critical. For correct reproduction the listener must be on the centerline between the speakers where each speaker is at a 30 degree angle to the listener as shown in FIG. 6*a*. While this angle has some flexibility the listener must be on the centerline in order for the "phantom center" image to be properly perceived. This is the key to the increased soundstage width that stereo is famous for. In most systems only one listener actually can hear this stereo effect since listeners to the right and left of the center listener will likely not perceive a stable center image and more likely will hear a right or left speaker predominate the soundstage. This is a real problem that has vexed the audiophile community for years. The additional speakers needed for multi-channel/home theater exacerbates the difficulty in set up.

Prior art loudspeakers have changed minimally since the advent of single-speaker monaural sound systems. The primary intent of the prior art loudspeaker is to energize the listening position directly. Prior art loudspeakers are built in several fundamental variations with the direct radiator or monopole the most common, while the omni-directional, dipolar, and bipolar types are less common. While certain designs aim to vary the direct/reflected sound ratio, they all share the common primary goal of directly energizing the space at the stereo listening position via direct sound from two locations right and left of the listener. Multi-channel or home theater systems add a center channel and two or more rear surround channels.

FIGS. 4*a* and 4*b* show typical Sound Pressure Level ("SPL") charts of a direct radiator prior art loudspeaker. FIG. 4*a* shows the frequency-dependant radiation in the form of an SPL polar chart 400 of a prior art loudspeaker. The primary directional output lobe or on axis response 404 of a full range speaker assembly 402 is shown in polar form. Speaker assemblies typically utilize a single full range acoustical transducer or transducer array that uses multiple transducers each designed to reproduce a specific range of frequencies. The polar response changes from omnidirectional to directional as frequency increases, with the highest frequencies exhibiting a high level of directional behavior. Dipolar, bipolar and omnidirectional radiators have fundamentally similar characteristics. The prior art loudspeaker is omni-directional below 2000 Hz nominally, while there is a significant loss of high-frequency information as data is taken off-axis. FIG. 4*b* describes the prior art direct radiator characteristics through various SPL vs. frequency charts 410. The frequency response demonstrates the characteristic reduction in higher frequency power as measurements are taken at 30° and 60° off axis. The design of a reduced signature loudspeaker requires techniques to address these characteristics.

FIG. 5 shows the effect when a sound source 200, like a loudspeaker, is located in a fixed position relative to the listener 208. Since the distance to each ear is constant the amplitude, timing and the HRTF cues generated all match, and therefore indicate, the location of the speaker. Recalling the energy/time curves of FIGS. 4*a* and 4*b* it should be noted that when the direct sound comes from a loudspeaker whose on axis directivity lobe is pointed at the listener, the listener will perceive the sound as coming from the loudspeaker location. As will be seen, a method will be disclosed to mitigate this localization.

In a stereo recording, the recorded HRTF cues are often different than that generated by the speaker location, causing confusion for the listener. In stereo recordings, amplitude is primarily manipulated to gain a sense of changing location or what we may refer to as realism. Although some phase or timing cues are recorded, the sense of hearing is looking for a match between all cues, which is not possible since the original recording and the location of the speaker are generating incongruent cues. As a result, the sense of realism and sonic accuracy suffers and confusion is increased.

Conventional stereo records one set of amplitude and phase cues representing the original performance; however, the use of the prior art loudspeaker results in the generation of a new set of amplitude, phase, and HRTF cues dependent on the location of the loudspeakers. This requires the sense of hearing to continually sort out these confusing localization cues resulting in listening fatigue and loss of clarity. The end result is that even the most accurate systems do not accurately reproduce the original event.

However, prior art loudspeakers identify the loudspeakers as the origin of sound because the three primary cues all match the loudspeaker location. The sensitivity of the sense of hearing is such that even a design that relies heavily on significant reflected energy may be readily identified. As a result, the recorded venue cues will be overridden and the sound is perceived to be reproduced in the listening room through the loudspeakers. Thus, a listener seated in the ideal position on the centerline of a soundstage will hear a sound stage composed of left at the left loudspeaker, right at the right loudspeaker and a phantom image is perceived at the center. The source of this problem is conventionally referred to as crosstalk, where each ear hears both loudspeakers.

Prior art loudspeakers create unnatural sonic situations because arrival time is critical to localization. For example, the creation of a phantom center image, that is, the appearance of a sound that is not generated by a sound source but a confluence of identical signals generated by two equidistant speakers and only if the listener is sitting on the centerline between these two speakers. In nature, sounds localized as coming from directly ahead originate from a single sound source that is directly ahead.

In addition, the fact that loudspeakers are physically static in a space generates another strong signature. FIG. 5 shows the temporal differential for different locations of sources in a quadrant of fixed radius. When a source is directly ahead the time differential between the ears is 0 milliseconds. The greatest time differential is for sounds directly to one side where the differential is related to the full diameter of the listeners head, nominally 0.70 milliseconds. When the sound source is in between these two extremes, the time differential may be approximately 0.35 milliseconds. As a result, a typical sound reproduction system will indicate to the human hearing sense that the "music" is coming from one location in the space, namely the location of the loudspeaker. This is in contrast to nature, for example in a concert hall, where sound comes from many localizable directions.

The current stereophonic system breaks down if the listener is not in the "stereo position." The acoustic obviousness of the prior art loudspeaker requires that the listener be optimally located along the centerline between the two loudspeakers. As the listener moves away from center the sound shifts to the nearest loudspeaker and the phantom center image moves toward that side or, in some cases, disappears altogether. Multiple listeners must sit in the same line in order to gain a sense of the stereo image, which is neither comfortable nor practical. To reduce this problem, a third or center loudspeaker is required to deliver a combined left and right signal to better locate centered sounds for those sitting outside the "stereo position." Multichannel sound accommodates multiple listeners more comfortably and now includes center and surround channels and loudspeakers. These additional channels assist in improving the perception of centered information for listeners away from the centerline, but they also complicate the number of sound sources that the sense of hearing must sort out.

Prior art loudspeakers are designed to directly energize the listening position(s) and not the listening space or room, which is a problem in the prior art. Additionally, the recording process must rely on higher frequency intensity cues to generate a wide sound field. This is effective in allowing good flexibility in the recording process but is another identifier in the localization chain.

The problems created by the conventional loudspeaker design and the recording process have resulted in separate groups of listeners, the stereo purist and the home theater listener. In either case, the effort required by the human sense of hearing to continually sort out the confusing soundstage results in listening fatigue and dissatisfaction.

The current understanding of loudspeaker crosstalk is that each loudspeaker communicates with both ears simultaneously, causing image blurring and other problems that lead to the loss of a true sense of a realistic sound stage. Current thinking is that the elimination of this crosstalk would allow true reproduction of recorded sound. However, the link between loudspeaker localization cues and crosstalk is not well controlled in the prior art.

Attempts to improve the stereophonic image generally focus on crosstalk reduction. A headphone that places a speaker over each ear is one solution and has proven dissatisfactory. The lack of HRTF cues is potentially a fundamental reason that headphones are disappointing. Headphones seem to be clearer and more intelligible, which appears to be a result of the lack of crosstalk. Amplitude crosstalk cancellation is often emphasized; however, phase and HRTF crosstalk are ignored.

Cross talk cancellation is achieved in the prior art through electronic and loudspeaker techniques.

Electronic cancellation techniques were first suggested by Atal and Schroeder in U.S. Pat. No. 3,236,949 directed to an "Apparent sound source translator," and were later improved and commercialized by others. For example, U.S. Pat. No. 4,218,585 to Carver discloses an electronic device for canceling interaural crosstalk by inverting and modifying one stereo signal and recombining it with a modified version of the other stereo signal. Performing this operation on both stereo signals, Carver claims to effect a cancellation of interaural crosstalk when delivered by the loudspeakers. U.S. Pat. No. 4,308,423 to Cohen describes an electronic device for canceling interaural crosstalk and amplifying off-axis stereo images by using the difference of the right and left channels These electronic cancellation techniques require very exact single seat set-up and may be upset by merely turning the listener's head. In addition, these systems appear to add new signals such that these systems prove unsatisfying; as a result none of these systems has found wide acceptance. The most fundamental flaw in crosstalk cancellation is that prior art loudspeakers generate phase and HRTF cues that complicate amplitude crosstalk reduction. Other electronic systems, like those introduced by Lexicon and the VMAx (virtual multi-axis) system developed by JBL/Harmon International have produced results that have not been well accepted in the market place.

Exaggeration techniques rely on accentuating certain cues to enhance the stereo image. These techniques increase the intensity of the L/R information by adding the difference signal in such a way that results in a 2R−L and 2L−R intensity exaggeration with the potential for some crosstalk cancellation. Others manipulate the spectral response using filters or digital signal processing ("DSP") techniques to exaggerate the HRTF effects. Many of the HRTF techniques assume a one-size-fits-all philosophy by using a "typical" pinna, torso, and head function. It is difficult to program individualized HRTF parameters, so this is not provided. HRTF techniques generally prove dissatisfactory over the long term and result in inconsistent and unrealistic sound stages.

The techniques of exaggeration attempt to overpower the sense of hearing in a manner similar to that of intensity based two-channel stereo with similar results. New and extraneous signals are introduced into the listening space that further confuse and fatigue the listener.

Loudspeaker based cross talk reduction has been suggested in several patents, such as U.S. Pat. No. 4,058,675 to Kobayashi et al. This patent discloses a means for canceling interaural crosstalk using inverted and delayed versions of the left and right stereo signals fed to a second pair of speakers arranged to produce the correct geometry. U.S. Pat. No. 4,199,658 to Iwahara discloses using a second pair of speakers to reproduce the cancellation signal, which is composed of a frequency- and phase-compensated version of the inverted main signal. This cancellation signal is fed to a speaker just outside the main speaker on the opposite side from which the cancellation signal was derived. One of the few commercialized crosstalk reduction loudspeakers is detailed in U.S. Pat. No. 4,489,432 to Polk and uses a system similar to Iwahara but uses the stereo difference signal (L−R) for cancellation, amplifying the left and right components of the signal; this was not particularly well received.

The patent and prior art record shows several attempts to solve the problem of realistic sound reproduction by placing acoustic drivers at angles other than directly toward listeners but these have also not been successful or commercialized in even a limited sense. It is instructive to categorize these loudspeakers and detail their underlying weaknesses.

Reflective loudspeakers typically are found in two categories, the first aims certain acoustic drivers toward walls and/or ceilings intending that these will reflect off these surfaces with the hope of widening the sound field beyond the left and right speaker cabinet locations or improve realism. Examples are shown in U.S. Pat. No. 4,266,092 to Barker and U.S. Pat. No. 4,961,226 to Saffran as well as the Bose VideoWave TV video monitor and many others. The second reflective type uses conventional push-pull drivers that direct sound vertically and move air upward toward a reflector that converts the direction to horizontal. Examples are shown in U.S. Pat. No. 5,485,521 to Yagisawa et al., U.S. Pat. No. 5,446,792 to Sango and U.S. Pat. No. 5,615,176 to LaCarrubba that describe their Acoustic Lens Technology and used in Bang and Olufsen's BeoLab 5 speakers for example.

These reflective type loudspeakers are actually wide dispersion speaker systems that feature strong ITD cues from the bass drivers and frequently include midrange or high frequency acoustic driver(s) that are directed toward listeners that combine with enough HRTF and IID cues from the reflected sound for the sense of hearing to locate the loudspeakers. The sound has a different character, but the result is still unfavorable.

Other solutions try to solve the problems of the prior art by placing speaker drivers at extreme angles relative to each other. Some focus on single cabinet designs, while others focus on more traditional multiple cabinets as well as employing additional electronics in attempts to improve "spaciousness".

One example is U.S. Pat. No. 5,553,147 to Pineau which places acoustic drivers in a single cabinet that is located on the center primary listening axis where the left and right drivers are 180 degrees apart (i.e., the left driver faces left and the right driver faces right). There may be some reduction of localization cues emitted by the loudspeaker at the cost of poor high-frequency response, but combined with very strong ITD and narrow HRTF cues; the listener's hearing sense will locate the array. While not addressed by Pineau it is likely that a severe high-frequency falloff will also be a deficit. The "back-to-back" type of speaker is a single cabinet omnidirectional that may have limited merit for a solitary listener on the centerline, but proves unsatisfactory for listeners off the centerline that will readily localize sound at the loudspeaker.

U.S. Pat. No. 5,870,484 to Greenberger describes two systems designed to control ITD cues by controlling the directivity of the systems' low-frequency response. The directional radiation patterns have main radiation lobes pointing in different directions. An electronic system is described that combines an electronic processor with unique loudspeakers to produce a "Signal Dependant Radiation (SDR) gradient loudspeaker". A loudspeaker only solution is claimed but not described that uses a wave-(guide) or horn loudspeaker solution. An objective in both systems is to increase the reflected-to-direct sound ratio. Greenberger focuses on the reduction of low-frequency (below a nominal 1500 hz) ITD. High-frequency IID cues as well as HRTF cues are neglected and the effectiveness of the ITD solution is not clearly shown leaving concerns that cabinet induced ITD cues and/or any leakage of the SDR solution will allow the sense of hearing to locate the loudspeaker. A number of transducer driver angles are proposed as well as many cabinet variations including the preferred embodiment, a coincident "back-to-back" type with similar problems to those detailed above with respect to Pineau's patent.

In this system an electronic solution uses modified stereo signals combined with unique loudspeaker configurations that are manipulated to produce a "signal dependant radiation gradient loudspeaker" with a polar response that directs more acoustic energy opposite the loudspeakers' location than toward center. The gradient-type loudspeaker requires unique signal processing electronics to be implemented, which is thus not compatible with prior art preamplifiers and processors. Alternately, additional boxes and controls may be required. The claimed loudspeaker solution requires the use of the wave-type (wave-guide) or horn loudspeakers to achieve a directional radiation pattern. These designs are not particularly popular due to size, cost, and sound quality problems especially in the low frequency spectrum acknowledged by Greenberger. Using low-frequency horns requires large cabinets that cause significant cabinet-induced ITD cues since cabinet cues will arrive before driver ITD cues and initiate localization. As a result no effort is made by Greenberger to detail the advantages of this loudspeaker solution.

Greenberger, Pineau, among others, show several single-cabinet designs that are intended to be placed in the center of the listening room. However, speakers must be spaced apart in order to generate HRTF angles of sufficient width to be believable. Narrow HRTF cues, as well as ITD cues, at minimum are responsible for the poor performance of coincident designs.

An effective but impractical solution is to place a large panel between the speakers and have the listener sit nose-to-panel, effectively splitting the room in acoustic two. This solution was suggested initially by Bock and Keele in 1986, and further developed by R. Glasgal; in a system he calls Ambiophonics. The technique produces results that are more consistent and realistic than electronic, loudspeaker, or combination techniques, but retain the solitary listener requirement.

These proposed solutions to the stereo problem demonstrate that there is a poor understanding of how to accurately reproduce sound. As detailed above, high acoustic signature sound generated by the loudspeakers essentially erases the original recorded venue cues. As will be seen, it is essential that, with the exception of a few specific cases, the listener must not be able to detect loudspeaker generated cues (i.e., IID, ITD and HRTF cues) on the first wave front that initiates perception as known and described by the Precedence Effect.

Prior art recording can range from simple two-channel right/left microphone recordings to elaborate multi-microphone arrays. Coincident and multi-microphone recordings tend to exaggerate directional cues. Recordings are typically made of several instruments and singers individually and then mixed into a pair of stereo signals. Various tracks are panned from center to left or right depending on the recording engineer's judgment. This is reasonable since stereo is fundamentally an amplitude driven medium and higher frequency sounds are more readily perceived as IID cues by the sense of hearing. The result may be unnatural, for example instruments may be spread across the sound stage such as a 20-foot wide drum kit with singers 20 feet apart. Prior art recording exaggerates left/right information and engineers tend to mix venues in the same recording which is common in current multi-track recordings. Multichannel recordings use similar techniques resulting in an increase in data storage space required by recordings.

SUMMARY OF THE INVENTION

Various embodiments of the present disclosure relate to a new understanding of how the human sense of hearing relates to sound reproduction. The Reduced Signature Loudspeaker (RSL) is a new class of speaker systems wherein sound propagates outward from the loudspeaker such that the listener is not on the primary directional axis of the loudspeaker. Since the loudspeaker sound is not reflected off a surface it is direct sound that can initiate perception according to the Law of the First Wave Front/Precedence Effect. The sound propagated by RSLs is propagated in parallel with the listener's ears on a substantially vertical plane. In summary, the human sense of hearing relies on a set of differential information gathered by both ears, which are analyzed within the context of time, which is important to humans' ability to localize sound. One of the capabilities of the human hearing sense is the ability to localize a sound source in a reverberant room because direct sound is received before the room reflections. As the Law of the First Wave Front/Precedence Effect indicates for example, the new stimulus of someone speaking is heard clearly while sounds arriving slightly later are ignored. The differential information that arrives first takes precedence over differential information that arrives later. The first arrival information establishes location while latter information establishes the kind of space the sound occurs in.

In an RSL system, sound also reflects off room surfaces. However, these are early reflections that serve as reinforcement based on the Precedence Effect. Additionally, it is important that the listener not be able to hear the loudspeaker-generated cues (i.e., IID, ITD or HRTF). The RSL functions very well with all current signals and therefore is not signal-dependant and does not require special drivers or additional electronics. The RSL works with the human sense of hearing while being more practical than a panel barrier described in the prior art.

The present disclosure is directed to sound reproduction loudspeaker systems and methods for their design. Various embodiments are applicable to all forms of sound reproduction systems including audio systems, television, home theater systems, automotive and computers equipped with sound. Additionally, various embodiments may be applied to sound reinforcement systems, automotive sound. In accordance with various embodiments, realistic sound reproduction is enhanced. In accordance with some embodiments, RSL spacing such that a nominal 60 degree angle between listener and speaker may be beneficial to provide acceptable HRTF cues.

Additionally, as opposed to an electronic solution, as explained above, the RSL functions with all prior signal processors, preamplifiers and in many configurations (e.g., stereo, monaural, binaural) and is thus not signal dependant. Additionally, RSLs do not require wave or horn type drivers, although horn designs are possible in different configurations than those explained above.

As explained above, conventional stereophonic systems require two distinct recorded channels comprised of left/center and right/center information, which is amplified to drive the conventional loudspeakers that are placed in the classic stereo triangle. The problem with the conventional loudspeakers is that they generate a high acoustic signature that allows the hearing sense to locate the loudspeakers. In accordance with various embodiments, RSLs mitigate the acoustic signature of the loudspeaker and limit the ability of the human sense of hearing to identify the speakers as the source of sound. In other words, the RSL method and apparatus minimize the localization cues generated by the loudspeakers enabling the sense of hearing to accept the recorded cues of the original performance as the source of sound.

The acoustic signature of a sound source is established by its location and the various cues that the human sense of hearing uses to perceive the source of sound. As a differential system, the human sense of hearing will "listen" for the primary cues of amplitude, phase/time, and HRTF differentials generated by the human ears and differentially processed by the human brain. These primary cues are taken as a whole, such that the best match of these cues will determine location. For example, assuming a sound coming from the right, the amplitude at the right or direct ear will be somewhat greater than the amplitude at the left or opposite ear; this results in an amplitude differential indicating right. Similarly the arrival time of the sound to the right ear will occur sooner than that of the left ear, so the phase or timing differential indicates a sound coming from the right. Finally, spectral shaping by the pinna and torso also differentially indicates a sound coming from the right. All of this happens continuously and the localization process will be initiated each time a new sound is detected according to the Law of the First Wave Front.

An important factor that enables humans' ability to localize is time. Recordings are made in real time with sound sources that are in different locations in a venue which changes the arrival time between each sound generator (e.g., musical instruments) and the recording microphone. As shown in FIG. 5, loudspeakers are located in a fixed position and their distance to each ear is constant, so the Interaural Time Difference will be constant; as a result, individual original sounds (e.g., instruments) seem to be coming from the same place, namely the loudspeaker. This has led to the popularity of multi-microphone recordings and loudness-based panning of sources between right and left channels. Since the sense of hearing is looking for a match between all cues and the original recording and the location of the speaker are generating incongruent cues, the sense of realism and accuracy suffers and the listener's confusion may increase.

Many loudspeakers feature a polar response pattern that directs most of its full range acoustical energy (e.g., sonic energy between 20 Hz and 20 kHz) toward the listener, causing strong loudspeaker localization cues to be generated. This constitutes a high acoustic signature. In accordance with various embodiments, RSLs reduce loudspeaker-generated localization cues and control the acoustic energy propagated into the listening space. In a RSL design, the first wave or direct sound does not carry strong loudspeaker cues, so the recording can be accepted by the listener as the environmental sound and not a reproduction of the environment by a loudspeaker.

RSLs may reduce loudspeaker localization cues while preserving wide HRTF cues. As a result, RSLs present the human sense of hearing with a plausible and more believable sonic event. The cues perceived are those of the original recorded event and are believable since they come from the proper direction location. The HRTFs generated are specific to the individual listener through the normal modification of sound pressures due to the listener's torso shape and pinna frequency shaping. In a RSL system, these individualized cues are more consistent and correct resulting in significantly improved realism. The reason for this increased realism is that there are no longer competing cues as in the conventional loudspeaker but coherent amplitude, phase/time, and HRTF cues that allow sonic images to be sensed outside of the loudspeaker boundary for the first time. The Law of First Wave/Precedence Effect comes into play such that the human sense of hearing is prone to accept the recorded cues assuming that any reflected sound within the room is not exaggerated.

Although humans commonly listen to reproduced sound and live music performances, a comparison of the characteristics of live versus reproduced sound through conventional stereo systems is very nebulous. In addition to being a single listener system, conventional stereo limits sound direction to between the speakers, while live sound can be a 360 degree experience. Multi-channel/home theater systems attempt to solve this problem by using additional channels that increase the number of sound sources that are limited by problems caused by conventional loudspeakers. The result is that a new event is generated, specific to that venue, which is at best a facsimile of the original recorded event.

In accordance with various embodiments, RSL's allow for a natural expansion and contraction of the sound stage as the sound sources themselves expand and contract. A characteristic of conventional systems is the constant confusion of sounds as the sense of hearing tries to make sense of both the recorded and the loudspeaker directional cues. This confusion is most apparent during complex passages in music where the individual instruments and singers become indistinct, something that the RSL avoids. In some embodiments, RSL-based systems achieve greater clarity, which reduces listener fatigue.

Systems and methods are provided to address each of the primary cues, IAD, ITD, and HRTF while ensuring that frequency response and other fundamental loudspeaker design principles are implemented and controlled. Systems and methods are detailed that allow for a RSL that addresses cost and complexity for various end uses. To accomplish this, systems and methods are disclosed that deal with each of the three primary cues—intensity, phase and HRTF—and assure that more of the recorded sound of the original venue is present in the first wave than sound produced by the loudspeaker.

BRIEF DESCRIPTION OF THE DRAWINGS

FIGS. 15*a*-15*d* shows the various mounting means to correct for high-frequency intensity loss;

FIGS. 18*a* and 18*c* show a first order RSL center fill system and loudspeaker assembly and FIGS. 18*b* and 18*d* shows an enhanced second order RSL center arrays in accordance with various embodiments;

FIGS. 19*a* and 19*c* show a first order RSL center-fill system and assembly to address standing waves and FIGS. 19*b* and 19*d* show a second order RSL center-fill system and assembly to address standing waves;

FIGS. 21*a* and 21*b* show bimodal Bipolar RSL loudspeakers operation in stereophonic and multi-channel systems. FIG. 21*c* shows the Main R/L or outward facing side of a first order Bimodal Bipole and FIG. 21*d* shows the center-fill or inward array side.

DETAILED DESCRIPTION OF THE INVENTION

In accordance with various embodiments, a Reduced Signature Loudspeaker (RSL) addresses each of the primary localization cues that enable the human sense of hearing to localize a conventional loudspeaker. While RSL's can be implemented in many variations to best perform their desired function, there are two fundamental categories or orders that can be defined. The basic design provides sufficient reduction in the sonic signature of the speaker to improve realism. This simple form addresses Interaural Intensity Differential (IID) and Head Related Transfer Function (HRTF) cues but does not address Interaural Time Differential (ITD) cues, since they can be minimized in certain applications without additional components. This type is referred to herein as a First Order RSL. To further reduce a loudspeaker's signature, ITD cues are addressed; this version is referred to herein as a Second Order RSL. The various RSLs become acoustically transparent to the listener, allowing the cues of the original venue to be heard distinctly.

Figure 6A:
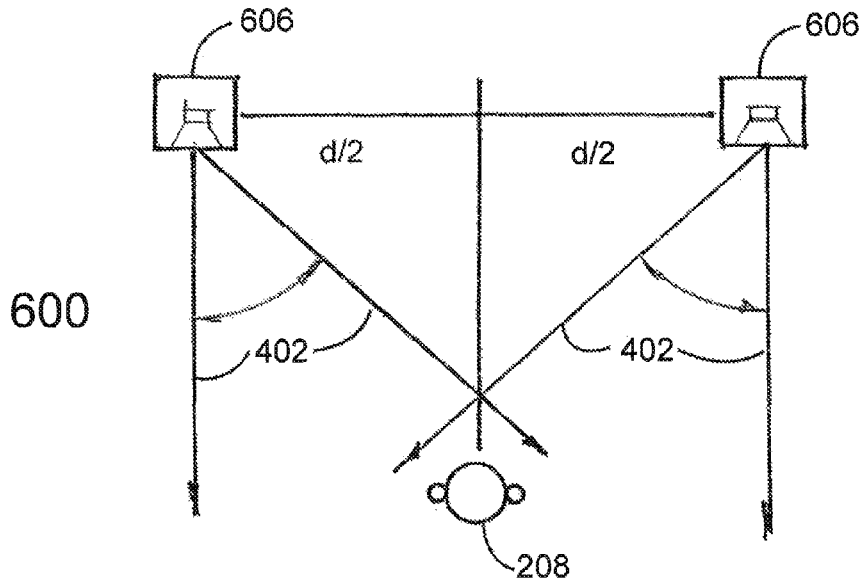
FIG. 6*a* shows the typical range of toe-in rotation for a conventional speaker arrangement that energizes the listening position on the centerline.
Figure 6B:
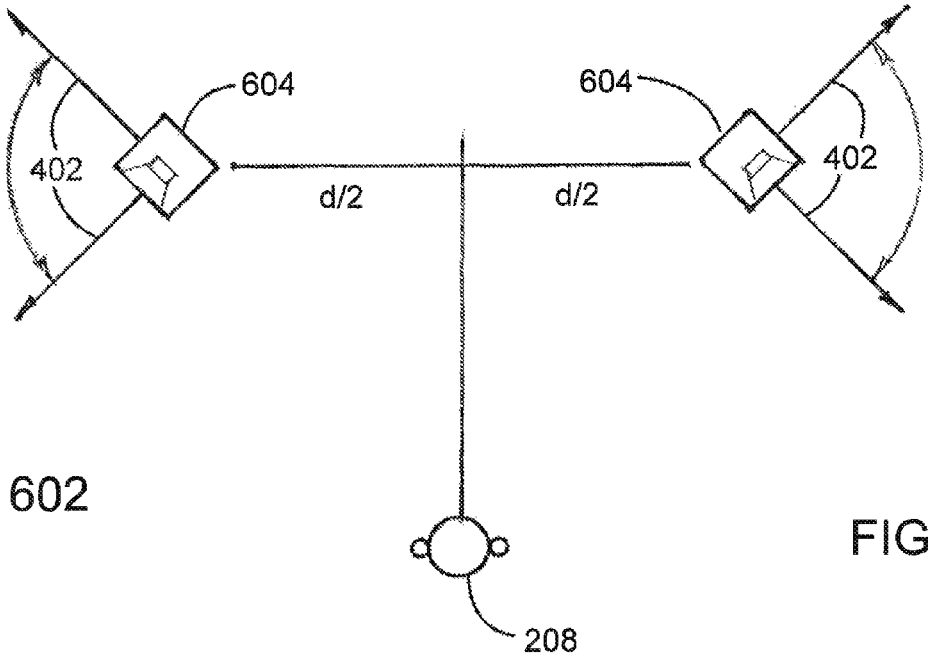
FIG. 6*b* shows the typical range of outward rotation for a Reduced Signature Loudspeaker (RSL) speaker arrangement that energizes the listening area on the centerline.

IID cues are the result of sounds above a nominal 700 Hz being increasingly blocked or shadowed by the head to the opposite ear causing a significant difference between the amplitude levels achieved at each ear. Reducing IID cues may be accomplished by turning conventional, direct radiator loudspeakers substantially 180 degrees outward from the centerline in a typical two channel stereo system. Loudspeaker rotation is clockwise for the left speaker and counterclockwise for the right speaker typically resulting in a mirror image cabinet construction. FIG. 6*b* shows a listener 208 and the full range primary directional output of the acoustic driver/array 402 of each RSL speaker 604 rotated a nominal +/−45 degrees in positioning during set up while substantially maintaining the effect. In this First Order RSL configuration, the mitigation of ITD cues is not addressed. FIG. 6*a* shows the listener 208, a conventional direct radiator loudspeaker 606, the full range primary directional output of the acoustic driver/array 402, and the range of commonly used rotational angles used in their set up of straight ahead at 90 degrees to 45 degrees canted in toward the listener 208 to optimize the stereo image. FIGS. 6*a* and 6*b* shows the fundamental difference between a conventional loudspeaker, which strives to acoustically energize the listening position, and the RSL, which acoustically energizes the listening space.

Figure 7A:
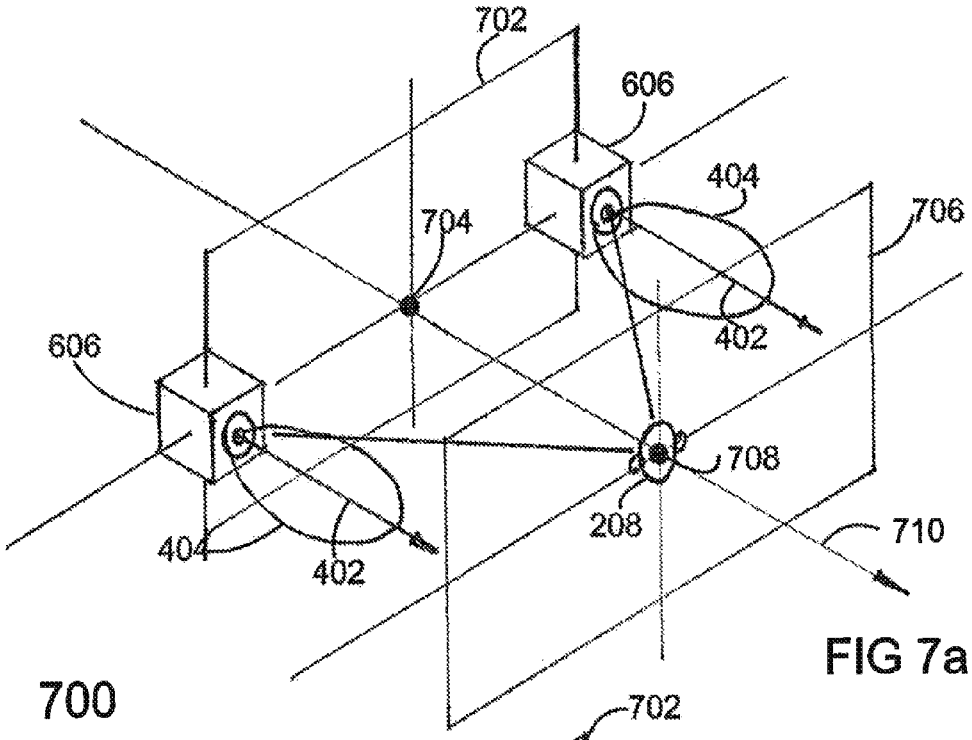
FIGS. 7*a* and 7*b* show conventional and RSL relationship loudspeakers full range directional acoustic output to listeners in space.

The fundamental difference between a prior art loudspeaker system and an RSL system is the relationship between the listener and the direction of the on-axis full range acoustic output of the speaker. Stereophonic loudspeaker systems are traditionally defined as an equilateral triangle wherein the right and left speakers are located in two corners of the triangle and pointed at the listener at the third corner of the triangle, each at an angle of 60 degrees as seen in FIG. 6*a*. For clarity loudspeaker systems can also be defined as a set of planes along which speakers, their full range directional acoustic outputs, and listeners are located in space as shown in FIG. 7*a*. Therefore a prior art loudspeaker system 700 can be shown as a first plane 702 defined by a point 704 designated the main or front loudspeaker system center and a second plane 706 defined by a point 708 designated as the listener center. A line 710 normal to said planes and passing through said center points wherein this line is designated the primary listening axis is shown in FIG. 7*a*.

Figure 7B:
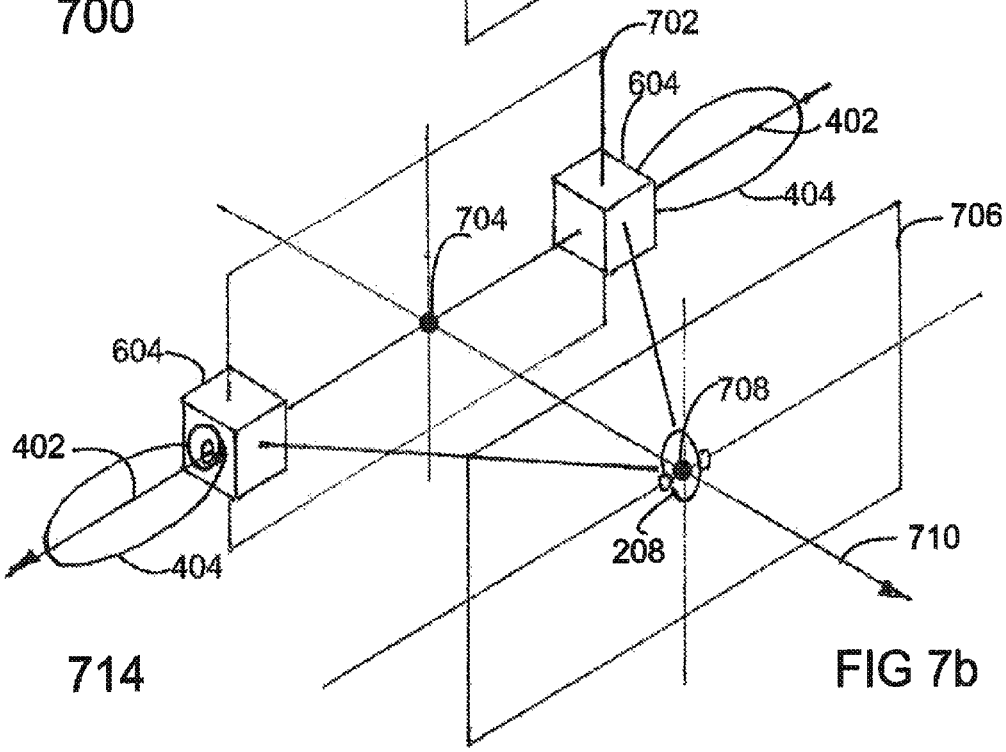

The prior art system 700 then is comprised of a set of at least one left and one right side front loudspeaker assemblies 606 wherein the on-axis full range directional acoustic outputs of the assembly 402 are directed toward the listener plane and essentially perpendicular to listeners ears or are pointed toward the listener center point. Each speaker then is essentially parallel to each other along the loudspeaker system plane with the primary listener(s) located along the listener plane with the primary listener at the center of listening axis Similarly an RSL loudspeaker system 714 can be shown as a first plane 702 defined by a point 704 designated the main or front loudspeaker system center and a second plane 706 defined by a point 708 designated as the listener center. A line 710 normal to said planes and passing through said center points wherein this line is designated the primary listening axis is shown in FIG. 7*b*. The RSL system then is comprised of a set of at least one left and one right side front loudspeaker assemblies 604 wherein the on-axis full range directional acoustic output of the assembly 402 are directed outward of loudspeaker system center and parallel to listeners ears, that is, with each speaker opposing each other at a nominal horizontal angle of 180+/−45 degrees along loudspeaker plane with the primary listener located at the center of said listening plane along the primary listening axis.

Figure 8A:
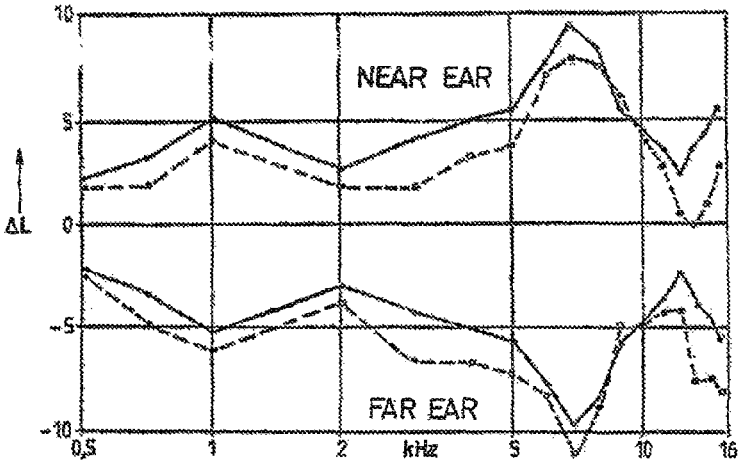
FIG. 8*a* the near and far ear response at a direction of incidence of 30 degrees.

As shown in FIG. 8*a*, the transfer function seen at each ear is different for sound sources originating outside the median plane. As a result, this is a key signature of sound sources and, since the amplitude differential is greatest at the higher frequency range, this is an area that may be improved upon to reduce the IID signature of a loudspeaker. In accordance with various embodiments, reducing IID cues can be accomplished by ensuring that the full frequency range directional acoustic output of the loudspeakers are directed outward of system center and parallel to listeners ears, which is an unexpected result determined by experimentation in developing the presently-disclosed embodiments. FIG. 9, which will be explained in further detail below, illustrates this concept. One method to measure IID reduction is to use comparative frequency response analysis at each "ear" to characterize the IID acoustic signature of a loudspeaker.

Figure 8B:
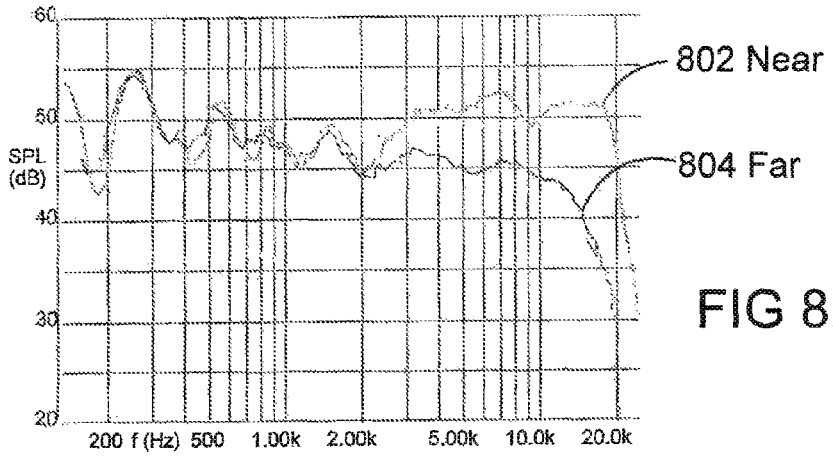
FIG. 8*b* shows the near and far ear frequency response as generated by a conventional loudspeaker.
Figure 8C:
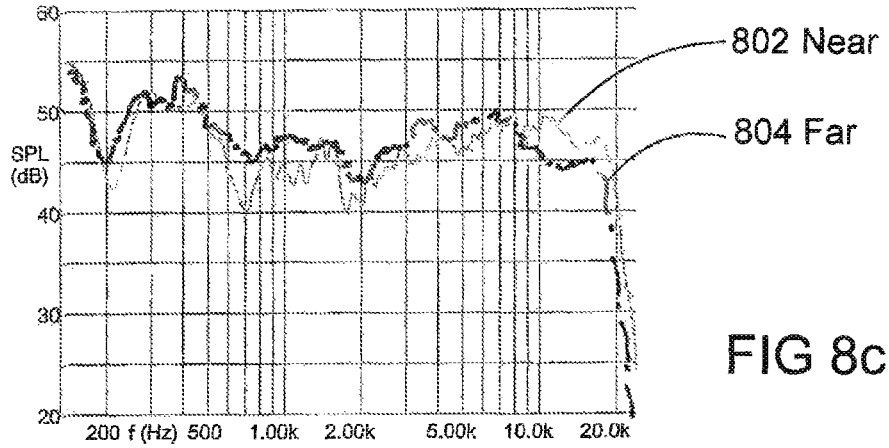
FIG. 8*c* shows near and far ear responses generated by a RSL.

In an exemplary experiment, loudspeakers using identical drivers are configured as conventional direct radiators and RSL speakers. In this example, data was acquired with Loudsoft FineSPL using an omni-directional microphone mounted with a foam sheet to separate the direct and opposite "ears" designed to simulate a listener's head. FIG. 8*b* details the resulting frequency response curves of the conventional direct radiator and shows that IID cues are characterized by high amplitude differentials primarily above 1000 Hz. In FIG. 8*c*, where the speaker has been configured to reduce IID cues, the frequency response recorded at each direct and opposite ears are essentially equal in intensity, thereby demonstrating that the IID signature of the speakers has been reduced, which was an unexpected result.

Figure 9A:
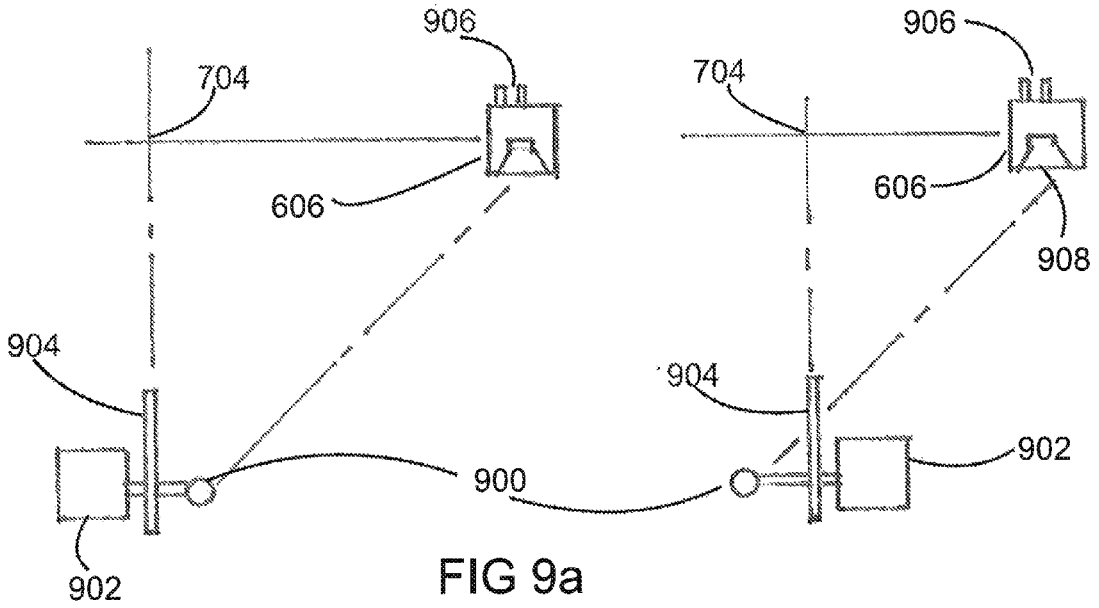
FIGS. 9*a* and 9*b* show a test setup used to compare loudspeakers operated in RSL and conventional modes.
Figure 9B:
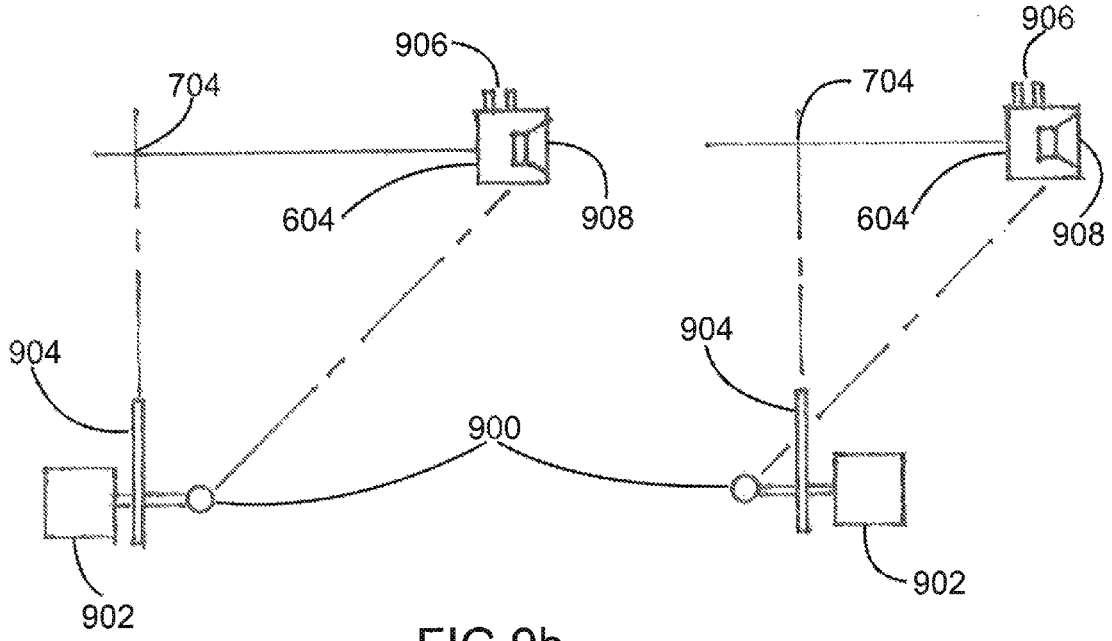

Referring to FIGS. 9*a* and 9*b*, a test setup is shown that may be used to compare loudspeakers operated in conventional and RSL modes. FIG. 9*a* shows the conventional direct radiator loudspeaker 606 placed to one side, (in this case, the right side) with a microphone 900 placed at the normal stereo listening position such that the test set up replicates the conditions in which the conventional loudspeaker 606 is used. The microphone 900 is coupled to a computer's sound card 902 and is shielded by a panel 904 (e.g., a foam panel as explained above), which is roughly the size of a human head. The panel 904 is placed at the normal stereo listening position on the centerline. The conventional speaker 606 is shown with terminals 906 opposite the full range acoustic driver 908 with optional bass reflex ports 910 shown either mounted on the front side along with either the driver 908 or on the rear side along with the terminals 906. The terminals 906 may comprise binding posts, wire clips, exposed wire, or other devices for speaker connections known to those skilled in the art. The test set up for a RSL 604 is shown in FIG. 9*b*. The RSL 604 is a First Order RSL, shown with a full range acoustic driver 908 facing outwards with the terminals 906 on an adjacent side with the optional bass reflex ports 910 shown either mounted either on the side along with the transducer 72 or on the rear side along with the terminals 906. In each case frequency response measurements are recorded for both the direct or near ear and the opposite or far ear as shown in FIGS. 8*b* and 8*c*.

FIG. 8*a* shows the mean monaural transfer constants (near ear and far ear) for a direction of sound incidence of 30 degrees (depicted as a dashed line) and half the IID (depicted as a solid line) according to the Journal of the Acoustical Society of America, Vol. 61, (1977), pages 1567-1576. FIGS. 8*b* and 8*c* graphically compare the frequency response at the near and far ears of a conventional direct radiator to that of a First Order RSL. As frequency increases above a nominal 800 Hz the ear that is closest to a sound source will sense greater amplitude than the far ear. This is due to shadowing of the high-frequency sound waves by the listeners head. As FIG. 8*b* shows, the actual at ear frequency response as generated by a conventional loudspeaker at about 30 degrees shows the high intensity differentials characteristic of conventional loudspeakers similar to the results shown in FIG. 8*a*. However, FIG. 8*c* shows the near 802 and far ear 804 responses generated by a RSL show ID levels that are essentially the same. The result is that the IID for the RSL is close to zero dB as compared to the conventional speaker IID value of greater than five dB. This ability causes the RSL to be difficult to locate by the human sense of hearing, particularly when compared to a conventional loudspeaker.

Figure 10A:
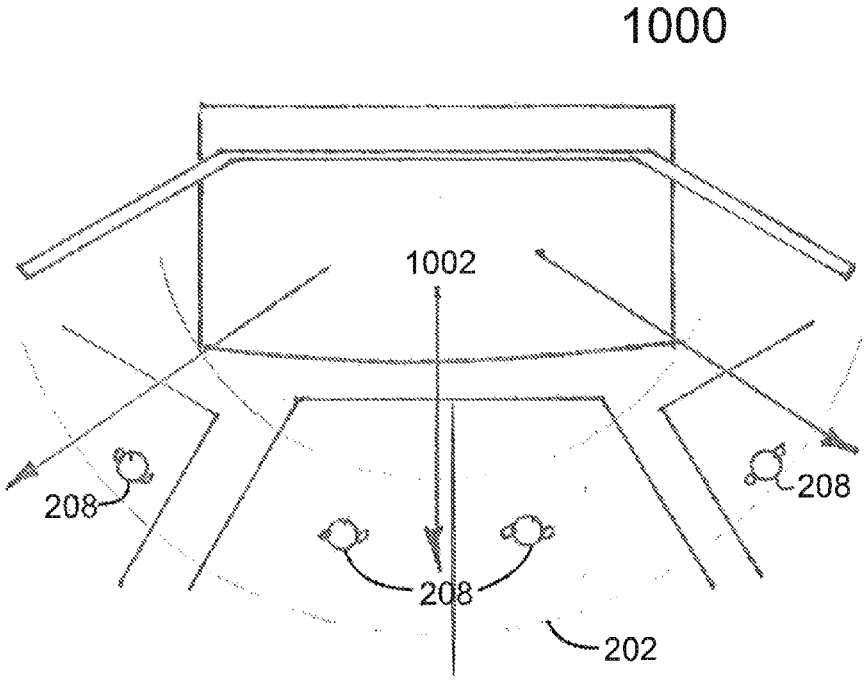
FIG. 10*a* shows sound propagating from an orchestra toward an audience that perceives sound initiated by the First Wave Front.

The combination of conventional loudspeakers and a stereophonic recording system works against the human sense of hearing and not with it. For comparison, a typical concert hall 1000 is shown in FIG. 10*a* with the orchestra 1002 centered in the hall. In some cases, the sounds generated by individuals in the orchestra combine to form a continuously changing First Wave Front 202 over time that will initiate localization of the event by listeners in the audience 208. As shown in FIG. 10*a*, the First Wave Front 202 begins at the orchestra 1002 and then expands outward toward the audience.

Figure 10B:
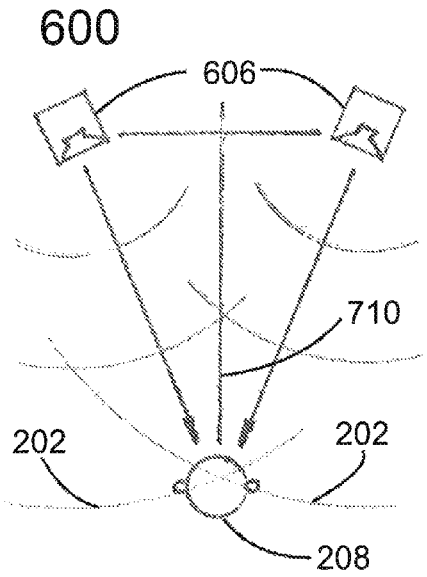
FIGS. 10*b* and 10*c* compares a conventional speaker system to that of a RSL speaker system.
Figure 10C:
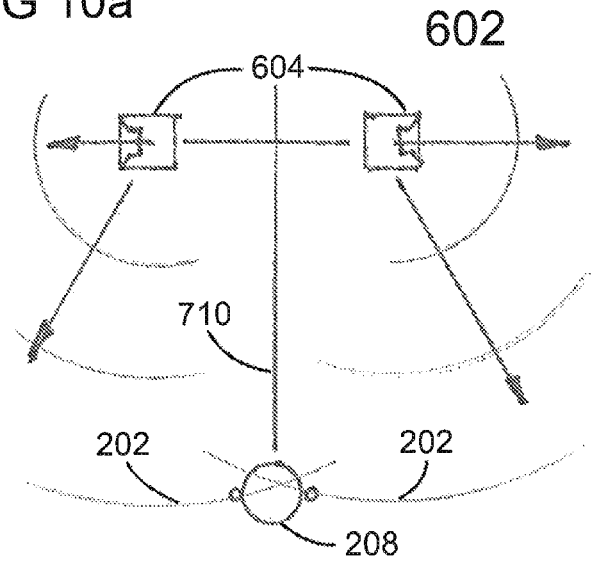

FIG. 10*b* shows a conventional stereo system that is intended to reproduce the sounds recorded of the orchestra. Conventional loudspeakers 606 are placed in the listening space in a manner that conventional wisdom suggests is best to experience "stereophonic sound". The loudspeakers 606 face the listener and are readily localized by the listener's sense of hearing. FIG. 10*c* shows an RSL 604, which is placed in a similar space, but oriented to project their acoustic output outward, much like that of the original venue.

FIGS. 10*b* and 10*c* illustrate the functional differences between the conventional loudspeaker 606 shown in FIG. 8*b* and the RSL 604. For example, in FIG. 10*b*, sound from the loudspeaker 606 that reach the listener on the First Wave Front 202 produces the characteristic high IID amplitude differentials that allows the human sense of hearing to localize the loudspeakers while in FIG. 10*c*, the sound from the RSL 604 is not readily localized by the listener 208, as was explained with respect to FIG. 8*c*. In FIG. 10*b*, a new event is created, namely that of the loudspeaker 606 in a specific listening space playing a recording of an orchestra, while in FIG. 10*c*, the experience of listening to the RSL 604 more closely resembles a recreated event of the original orchestra.

Figure 11:
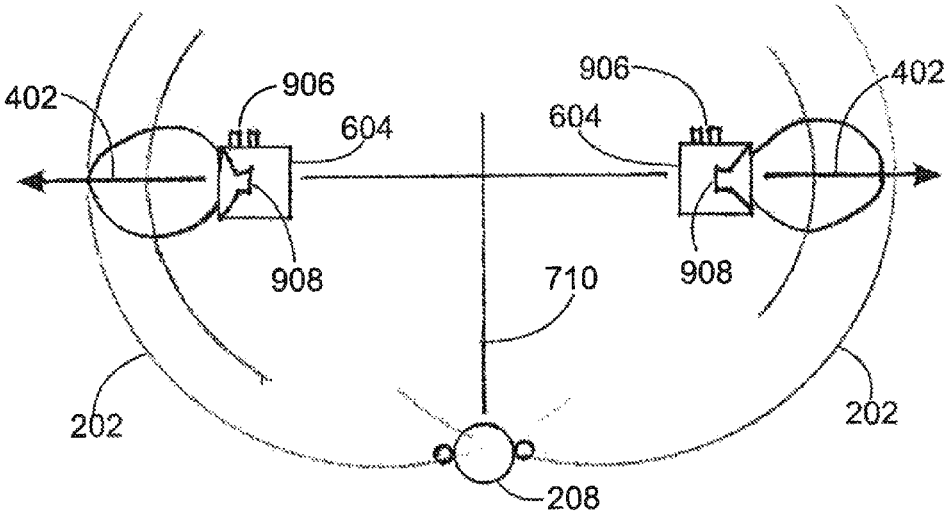
FIG. 11 shows a method to reduce the loudspeaker Interaural Intensity Difference (ID) and HRTF difference signature.

FIG. 11 shows a First Order RSL system 1100 wherein I'D cues are reduced while HRTF cues are retained and made more natural and real to the listener. Two First Order RSL's 604 are placed normally for a current art stereo system. The full range speakers' 908 acoustic output 402 is directed parallel and outward of to the listener's 208 ears. It is critical that no loudspeaker generated cues in the IID range of a nominal 700 Hz and above can reach the listener 208 in the first wave 202. In order to ensure this, any bass reflex ports must face rearwards or be on the same side as the full range driver.

Although this solution achieves a reduction in IID cues, certain results may be problematic. First, high-frequency response is poor, which yields inadequate high-frequency levels and reduced HRTF cue levels. Second, listening tests indicate loudspeaker ITD cues are present, which may limit seating to the classic centerline seating of conventional stereo. These limitations may be acceptable for some applications, but the results are First Order RSL and may not represent the full capability of RSL technology in accordance with various embodiments.

Figure 12:
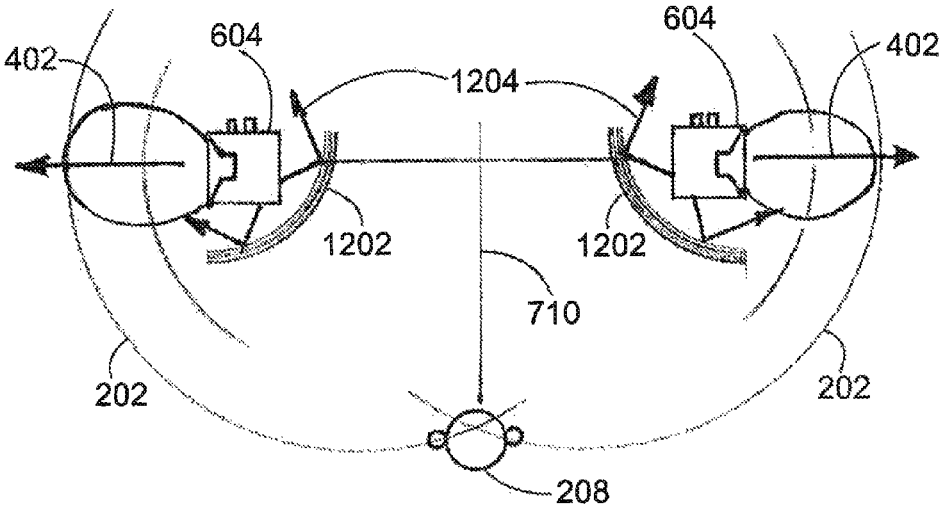
FIG. 12 shows a method to reduce the loudspeaker Interaural Time Difference (ITD) difference signature.

ITD cues are difficult to control since loudspeakers are omni-directional from roughly 2000 Hz and below. As a result, it is difficult to adjust the polar response away from the listener. FIG. 12 shows an ITD cue strategy where a secondary reflective baffle or diffuser 1202 is shaped to capture and redirect sound waves 1204 generated by the full range acoustic transducer and its cabinet away from the listener 208. This secondary diffuser 1204 then has shown to be effective in delaying, that is, redirecting and/or shielding the low-frequency sound 1202 from the listener 208. The result is that the first wave front 202 no longer carries loudspeaker ITD or IID cues and the listener 208 perceives the original sound. Controlling both IID and ITD cues makes this a Second Order RSL system 1200. Ideally, an acoustic break is provided (i.e., the secondary diffuser 1202 is not connected to the loudspeaker 604), to prevent critical frequencies above 100 Hz and up from being inadvertently radiated by the secondary diffuser 1202. This diffuser can be of any shape including cylindrical.

Solutions to the ITD problem are not limited to the secondary diffuser 1202 since it is possible that DSP cancellation, highly damped cabinets, double wall construction or other methods may be effective. However, the secondary diffuser 1202 is simple and effective.

RSL cabinets may be rotated to some extent depending on the dispersion characteristics of the drivers used. For example, referring back to FIG. 6*b*, rotation toward the listener 208 is limited by the transition from a reduced acoustic signature to a high acoustic signature. However, rotation away from the listener 208 may be helpful in situations where the RSL cabinets 604 are spaced closer than is optimal, while the opposite is true regarding RSL cabinets 604 spaced further than is optimal.

The importance of HRTF cues is frequently overlooked as a key factor in accurate and believable sound reproduction. There are two key elements that are required: first, the sound source must be at a sufficient angle such that the HRTF cues generated by the sound reproduction system more closely match that of the original venue and second, the level of high-frequency sound has sufficient amplitude to carry sufficient information and, ideally, match the level of the original venue. The availability of a wide pinna angle is more important than extended frequency response. If the angle is greater than the original venue, the result is not a stretching of the sound field, rather the sound field appears to expand and contract naturally as, for example, a full orchestra to solo instrumentalist.

Figure 13A:
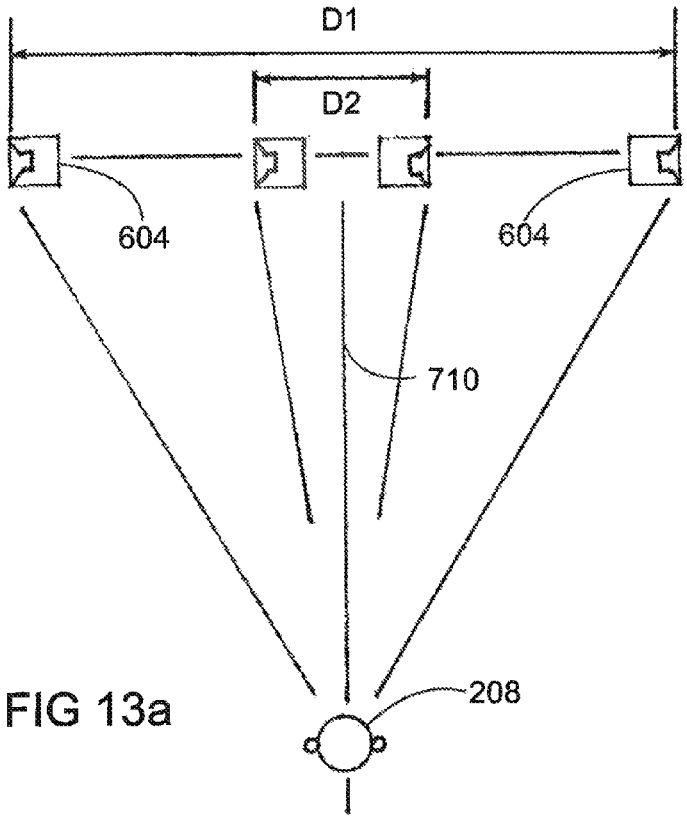
FIGS. 13*a*-13*d* show various solutions to improve HRTF cues in accordance with various embodiments.

As shown in FIG. 13*a*, locating loudspeaker cabinets 604 at distances of separation great enough to yield angles of 30 degrees at the listener from the center position 710 is a key strategy. The need for reasonably wide loudspeaker spacing predicts that single cabinet/coincident designs will not be effective due to the very limited pinna angles generated. Situations may arise where closely spaced drivers are unavoidable as in TV and computer applications and strategies will be detailed below to make the best of these situations.

Figure 1:
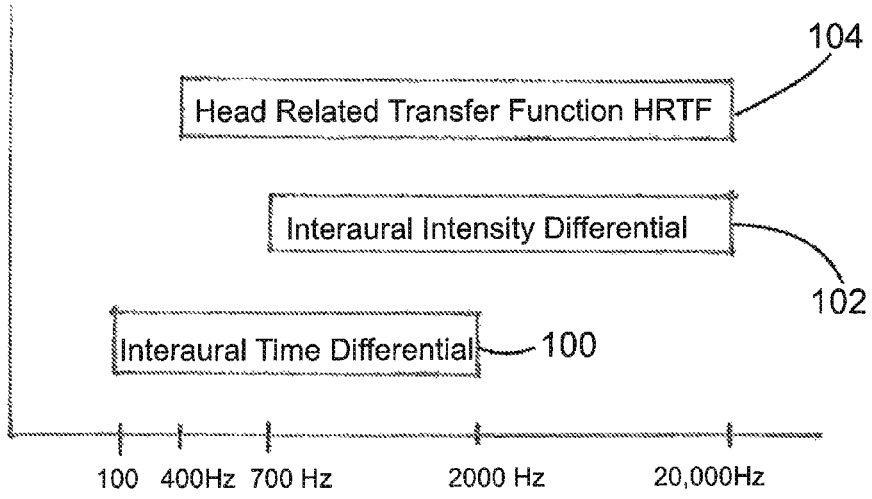
FIG. 1 shows a graph of the spectral (frequency) correlation of the primary localization cues.
Figure 2:
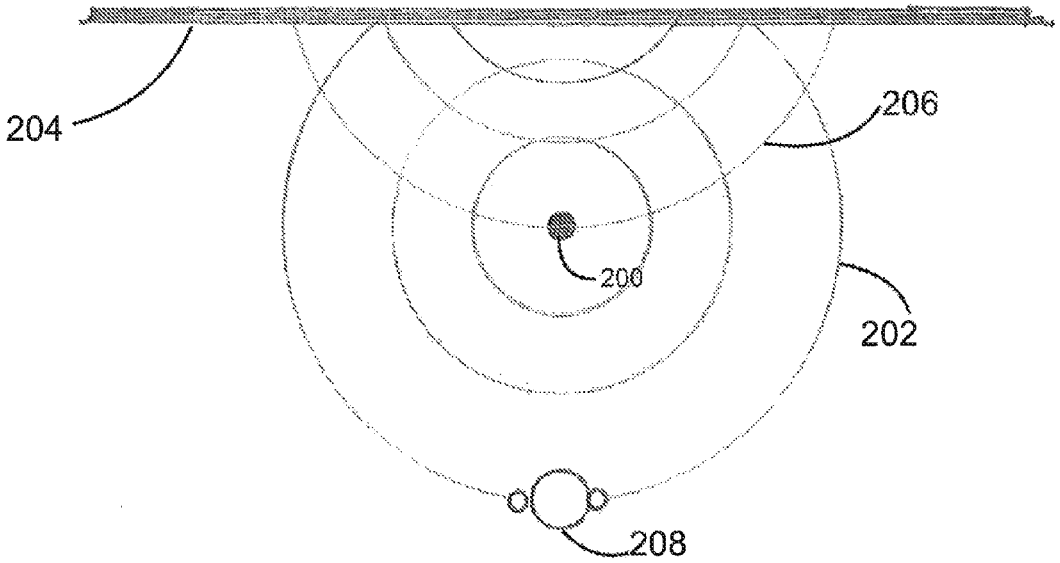
FIG. 2 shows the temporal or phase relationship between acoustic reflections and the First Wave.
Figure 3A:
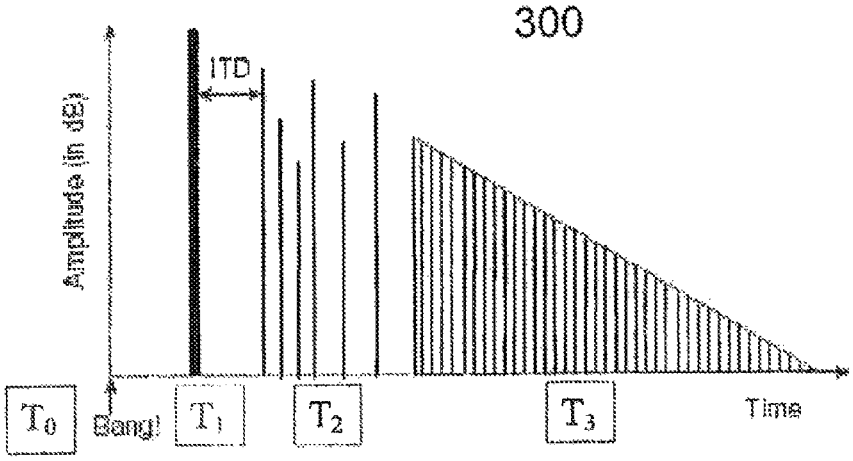
FIG. 3*a* shows a generalized Energy Time Curve.
Figure 3B:
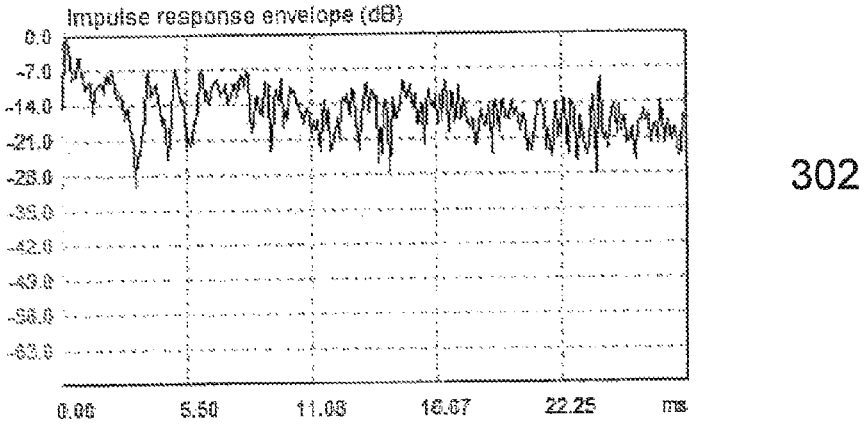
FIG. 3*b* shows an actual Energy time Curve in-room measurement.
Figure 4A:
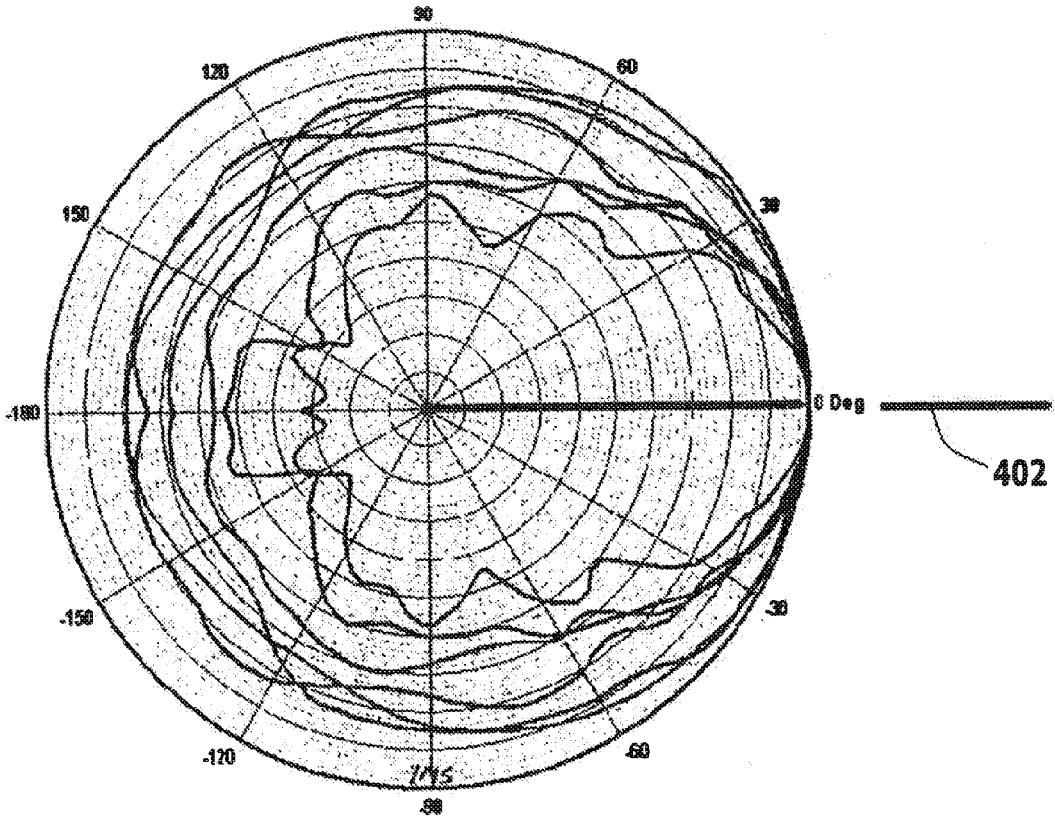
FIG. 4*a* shows an SPL polar chart of a conventional direct radiator characteristic frequency-dependant radiation.
Figure 4B:
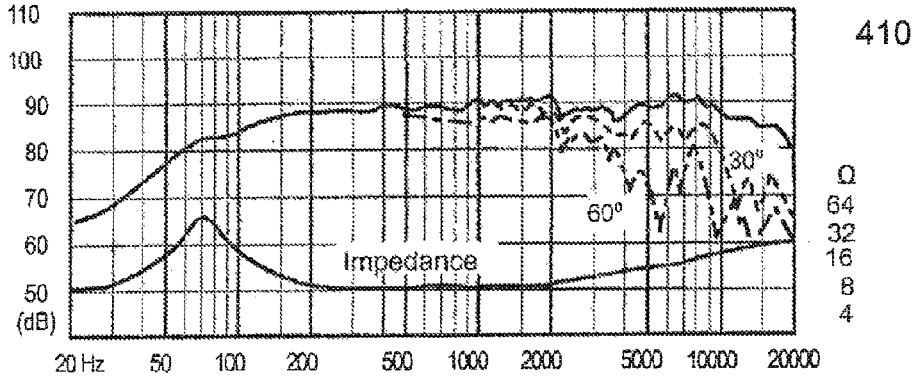
FIG. 4*b* shows an SPL vs. frequency chart of a conventional direct radiator.
Figure 5:
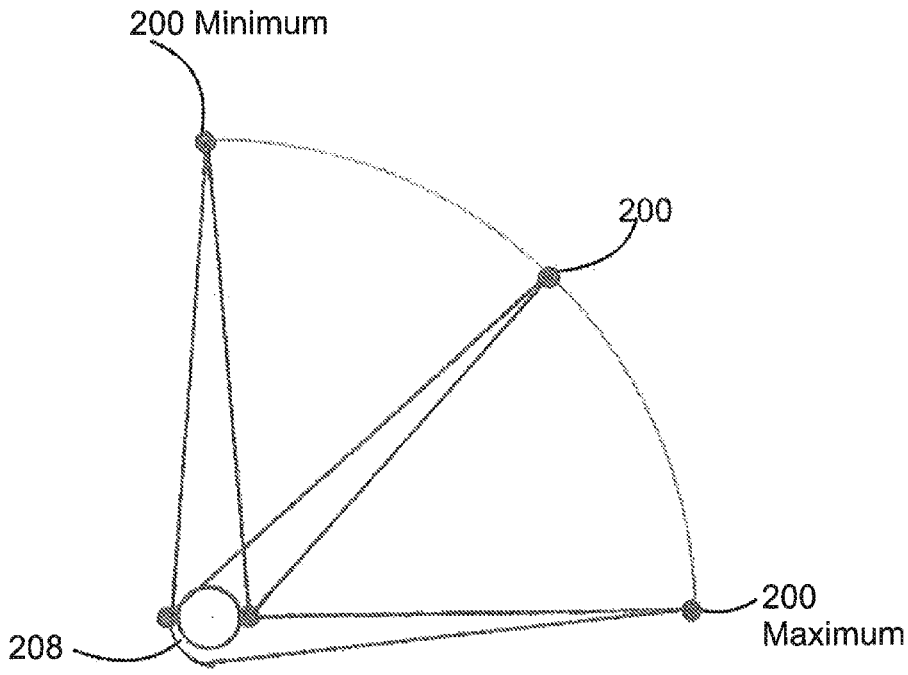
FIG. 5 shows the Interaural Time Difference (ITD) as a function of azimuth.

Methods to produce sufficient high-frequency levels are somewhat more difficult since the high frequency intensity of all acoustic driver technologies falls off greatly as the listening angle increases away from the centerline as shown previously in FIG. 4*b*. For example, the tendency of most tweeter drivers is to beam or exhibit a more narrow polar response that will limit high-frequency amplitude at the listening position (s). This explains the temptation some listeners have to angle speakers toward the center listing position to achieve a flatter frequently response. For example, as indicated in FIG. 4*b*, it is common for the high frequency level to decrease a very significant 10 dB or more at 30 to 45 degrees offset and 20 dB or more at 60 to 75 degrees offset while at 90 degrees the level may be nearly inaudible at frequencies above 10,000 Hz.

Figure 13B:
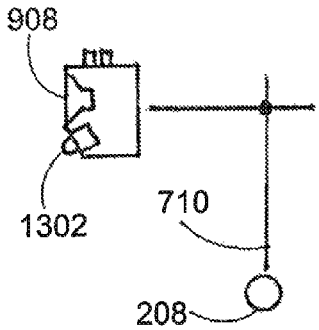
Figure 13C:
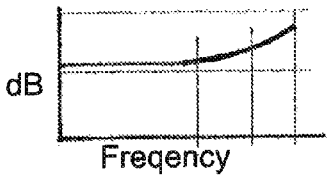
Figure 13D:
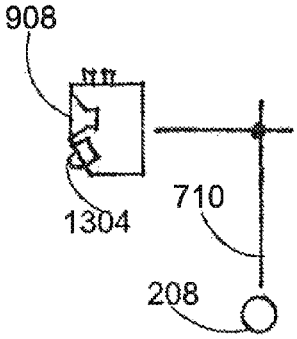

There are several strategies that may be employed to extend the high frequency response of an RSL system at the listener (s). As shown in FIG. 13*b*, the angle of the tweeter driver may be changed to position this driver more toward the listener 208; The frequency response of the electronics may be shaped via tone controls or an equalizer as shown in FIG. 13*c*. In practice these techniques have their limits and likely will not compensate fully since tweeters usually have limited power handling ability and may not be powerful enough to compensate for the typical offset of 90 degrees from centerline 710 or more. A line source of multiple tweeters is possible but is costly. The most effective means appears to be the addition of a super tweeter 1304 that uses a high pass filter set at a fairly high-frequency, for example, 10,000 Hz. As shown in FIG. 13*d*, the combination of a super tweeter 1304 that is also angled more toward the listener than the full range speaker/array or coaxial transducer 908 driver appears most effective.

Figure 14A:
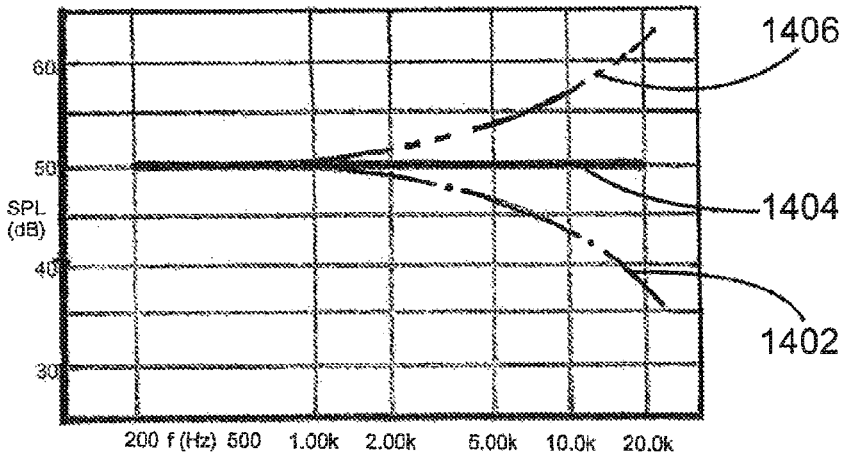
FIGS. 14*a* and 14*b* graphically shows the method to correct for high-frequency intensity loss
Figure 14B:
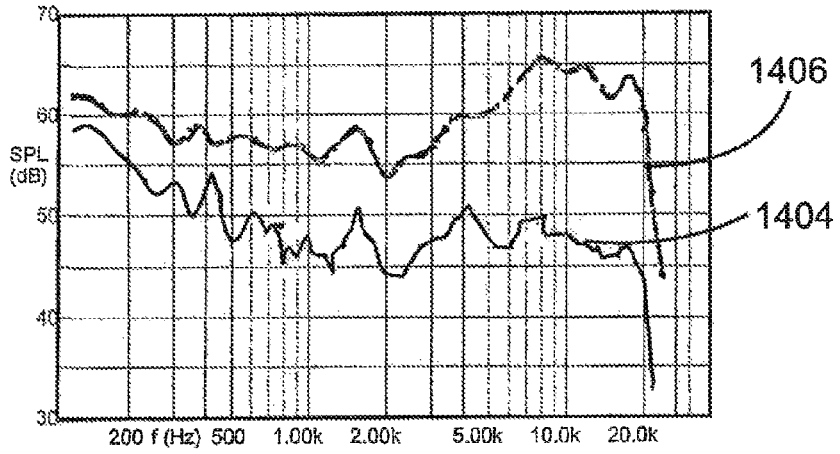

FIG. 14*a* is a graph showing a simplified set of high-frequency response curves that demonstrate the method to correct the loss of high-frequency level that are the result of operating the RSL off axis. The uncompensated response 1402 ideally is improved by the use of the various compensation techniques that increase the system high-frequency response 1406 resulting in the corrected high frequency response 1404 that is now extended. An actual example is shown in FIG. 14*b* where the compensated high frequency response 1406 is shown wherein the response at the listener 1404 is now essentially flat within +/−3 db.

FIG. 15*a* though FIG. 15*d* show various methods that may be used to provide an extended high frequency response at the listener(s). One method is comprised of a tweeter and/or super tweeter array 1502 mounted to a fifth side provided at an angle to the first side. The angle of the fifth side with respect to the first side is an acute angle and the tweeter and/or super tweeter array 1502 has a crossover setting to provide and extended high frequency response at the listener.

Various mounting means are shown that can be used to correct the high frequency response. Optionally, the tweeter/super tweeter assemblies 1502 may be mounted in a number of ways that include an angled bracket 1504 as shown in FIG. 15*b*, a top mount 1508 as shown in FIG. 15*d*, a ball and socket mount 1506 as shown in FIG. 15*e*, or any other mount understood by one skilled in the art. The purpose of the mounting apparatus is to improve system high-frequency response, which also improves HRTF performance. As will be seen, these methods are effective for all types of RSL loudspeakers.

Angles of rotation of both the array and the individual drivers may be adjusted to control frequency response. Driver rotation is the physical rotation of driver placement in the cabinet in multi-driver systems. It may be advantageous to rotate drivers or angle them to improve the arrays' polar response pattern. This may be used to provide for a flatter frequency response at the listing positions. Although these techniques to address IID, ITD, and pima cues have proven to be effective in prototypes to date, this disclosure is not limited to these suggestions; other techniques may also meet the objectives defined by these concepts.

The RSL may be implemented in a number of variations to best achieve the desired function. As in conventional loudspeaker designs, it is reasonable that many designs will proliferate as various designers will have differing performance, aesthetic and cost objectives. Thus, various systems and arrays can accommodate more listeners, better fit specific applications, all at varying cost and complexity. The following disclosure details exemplary embodiments of RSL technology.

The First Order RSL discussed above may be useful for the single listener in the stereo "sweet spot" since, as in conventional stereo, phase cues are essentially equal for each speaker resulting in limited loudspeaker localization due to ITD cues. While the seating position is not as critical as in conventional systems, limited lateral movement is required to maintain good imaging. This design may be best suited for two-channel or single-listener situations, near field applications such as computer sound, or systems where cost is a main concern.

The basic design may be referred to as a First Order Main Left/Right RSL and is shown in FIG. 11. In this implementation, two RSL loudspeakers 604, in minor image, are arranged in a typical stereo triangle. The purpose of the outwardly splayed driver direction is to provide the necessary wide-angle HRTF cues while minimizing IID cues. In this embodiment loudspeaker generated cues in the IID range of a nominal 700 Hz and above are minimized on the First Wave 202 that initiates localization by the listeners 208.

The addition of an ITD diffuser 1202 makes this embodiment a Second Order Main Left/Right RSL and the diffuser is located in such a way as to collect and redirect acoustic driver and cabinet energy away from the listener 208 to control ITD cues, as shown in FIG. 12. Ideally, the ITD diffuser 1202 is acoustically isolated from the primary baffle/cabinet in order to avoid primary cabinet vibrations from being coupled to and then transmitted by the ITD diffuser 1202.

In both the First and Second Order basic RSL cases, weak HRTF cues due to poor high frequency response will need to be augmented by crossover filter changes, reduced tweeter 1302/1304 angles as shown previously in FIG. 13*b* and others, and/or the addition of a super tweeter 13004 or electronically at the amplifier in order to provide a true representation of the original sound.

The addition of an ITD diffuser 1202 that reduces ITD loudspeaker cues and angled high frequency drivers 1302/1304 that provide an enhanced high frequency response at the listening position are improvements to a simple First Order RSL design. The result is a more accurate stereophonic image of the original venue with recordings ranging from monaural to stereo to binaural.

FIGS. 16-25 detail various RSL configurations in accordance with various embodiments. Two classes are discussed; the first is the First Order RSL that controls both HRTF and IID cues and the second is the Second Order RSL that additionally controls the more challenging ITD cues. Each class includes a total of three configurations, Main Left/Right, Center-Fill, and Bimodal Bipole. Each of these can also be used for surround channels as will be detailed.

The first RSL array configuration is the main L/R loudspeaker as shown in FIGS. 11 and 12. Conventionally, the purpose of the Main L/R RSL array in a two channel stereophonic system is to provide the primary source of sound. The RSL technology features the outwardly splayed driver direction that provides for wide-angle HRTF cues and minimizes IID cues, both necessary for the creation of realistic sound fields.

Figure 16A:
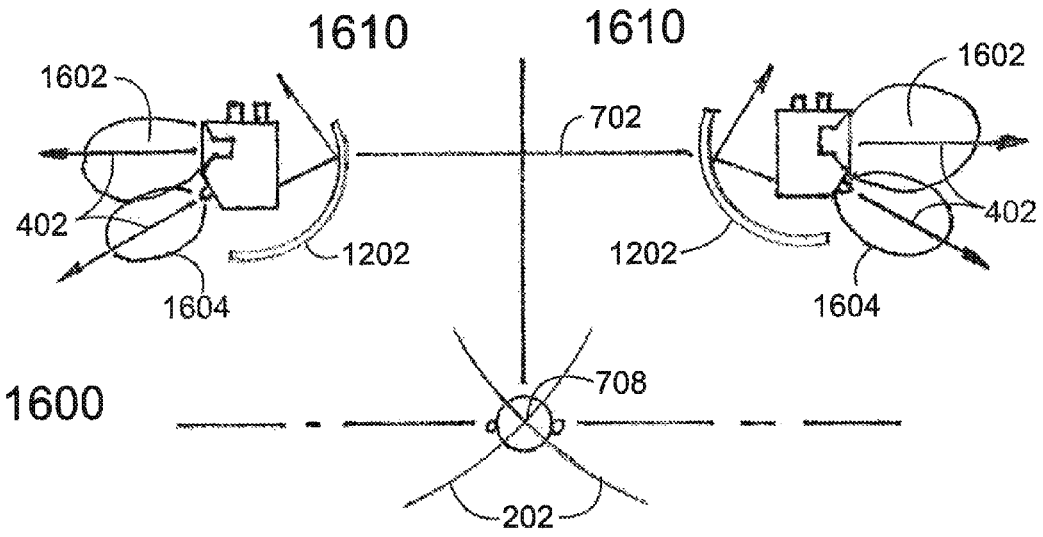
FIGS. 16*a* and 16*b* show an enhanced second order RSL Main L/R array in accordance with various embodiments.

FIG. 16*a* shows a generalized top view of a main left/right RSL speaker system 1600 that is enhanced with the previously mentioned solutions to improve high frequency response and reduce ITD cues. The enhanced RSL system 1600 is comprised of two spaced enhanced Second Order RSL Main speaker assemblies 1610 where one assembly faces right and the other left with the listener 708 positioned on the primary listening axis 710. The loudspeakers are disposed one left and the other right. The on-axis directional acoustic directivity lines 402 are shown along with their associated polar lobes for both the full range acoustic transducers output 1602 and the high frequency acoustic transducer or tweeter 1604. The system layout ideally forms an equilateral triangle. This main left/right RSL system can also be defined as a set of planes normal to the primary listening axis 710 with the loudspeaker plane defined by the loudspeaker center point 704 and the listener plane defined by the listener center point 704 as previously mentioned regarding FIG. 7*b*.

Figure 16B:
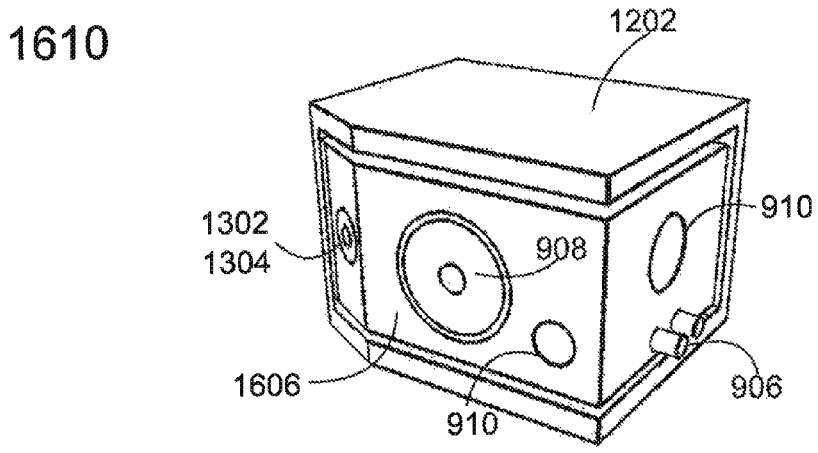

As shown in FIG. 16*b* each speaker assembly 1610 is comprised of a cabinet or enclosure having a plurality of sides 1606, a full range acoustic transducer/array 908 mounted to a first side, a set of speaker wire input terminals 906 mounted orthogonal to a second side, and a high frequency acoustic transducer or tweeter and/or super tweeter 1302 and 1304 respectively mounted to a third side at an acute angle to the first side. Optional bass reflex port(s) 910 may be provided on the same side as the full range driver 908 or on the side containing the speaker wire connector 906. These speaker assemblies may be of any shape including cylindrically-shaped.

Each speaker is also comprised of an ITD diffuser 1202 as shown in FIG. 16*b* wherein the diffuser is located in such a way as to collect and redirect this energy away from the listener to control ITD cues. Ideally, the ITD diffuser 1202 is acoustically isolated from the primary baffle/cabinet 1606 in order to avoid primary cabinet vibrations from being coupled to and then transmitted by the ITD diffuser 1202.

In summary, FIG. 16*b* shows a Second Order Main L/R RSL speaker assembly 1610 along with the orientation of each acoustic driver 908 and 1302/1304, optional bass reflex port locations 910, and speaker wire input terminals 906. FIG. 16*b* also shows the assembly 1600 that is further comprised of a secondary baffle or diffuser that is located in such a way as to collect and redirect sound energy from the cabinet/enclosure 1606 and acoustic driver generated sound away from the listener 208 to control ITD cues.

One characteristic of the Main Left/Right RSL array is the tendency for the phantom center image to be somewhat lower in amplitude than may be desired. Controlling the center amplitude or level is helpful in both single and multiple listener situations. In order to improve this situation, a second type of RSL array is described and is referred to as the center fill array. A center fill RSL can utilize monaural, left and right stereo or multi-channel center as input signals. This array is used to fill in and center the sonic image similar to that of a fill flash in photography where the main lighting is augmented by a source of lesser intensity. By contrast, the function the of the center channel loudspeaker in conventional multi-channel systems is to be a primary source of sound and is driven by a unique signal that is derived from the sum of the left and right channels.

Figure 17A:
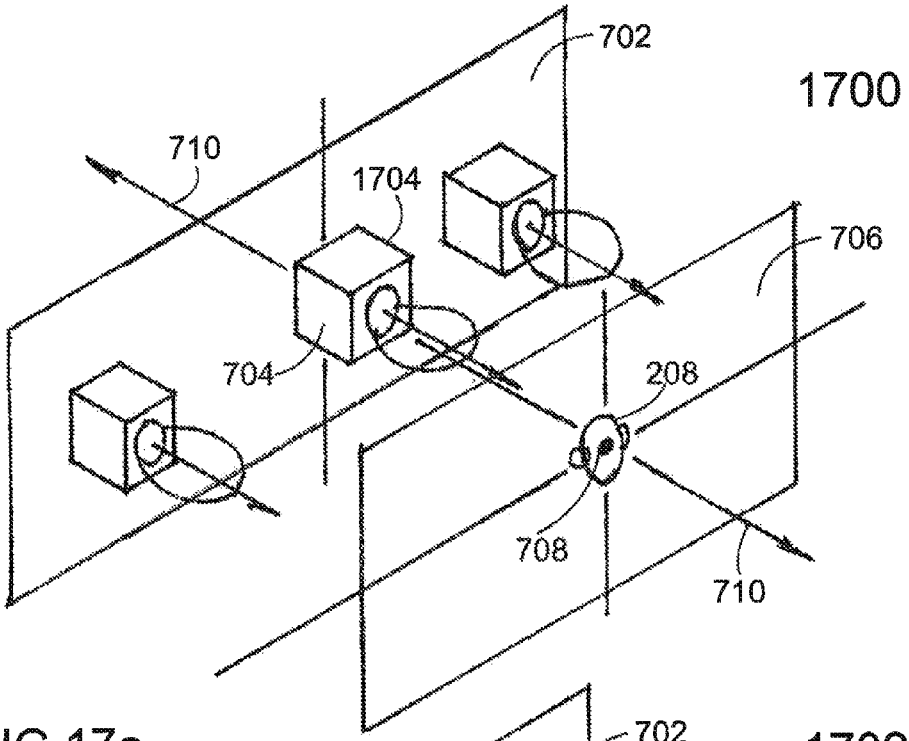
FIGS. 17*a* and 17*b* shows a comparison of the relationship of loudspeakers full range directional acoustic output to listeners in space for center loudspeaker solutions in conventional and RSL multi-channel systems.

As mentioned previously the fundamental difference between a prior art loudspeaker system and an RSL system is the relationship between the listener and the direction of the on-axis full range acoustic output of the speaker. In the prior art the center channel speaker 1704 is pointed at the primary listener with that listener located on the primary listening axis as shown in FIG. 17*a*. And loudspeaker systems can also be defined as a set of planes along which speakers, their full range directional acoustic outputs, and listeners are located in space. Therefore the center speaker in a prior art multi-channel loudspeaker system 1700 can be shown located on a first plane 702 defined by a point 704 designated the main or front loudspeaker system center and a second plane 706 defined by a point 708 designated as the listener center. A line 710 normal to said planes and passing through said center points wherein this line is designated the primary listening axis is also shown in FIG. 17*a*.

Figure 17B:
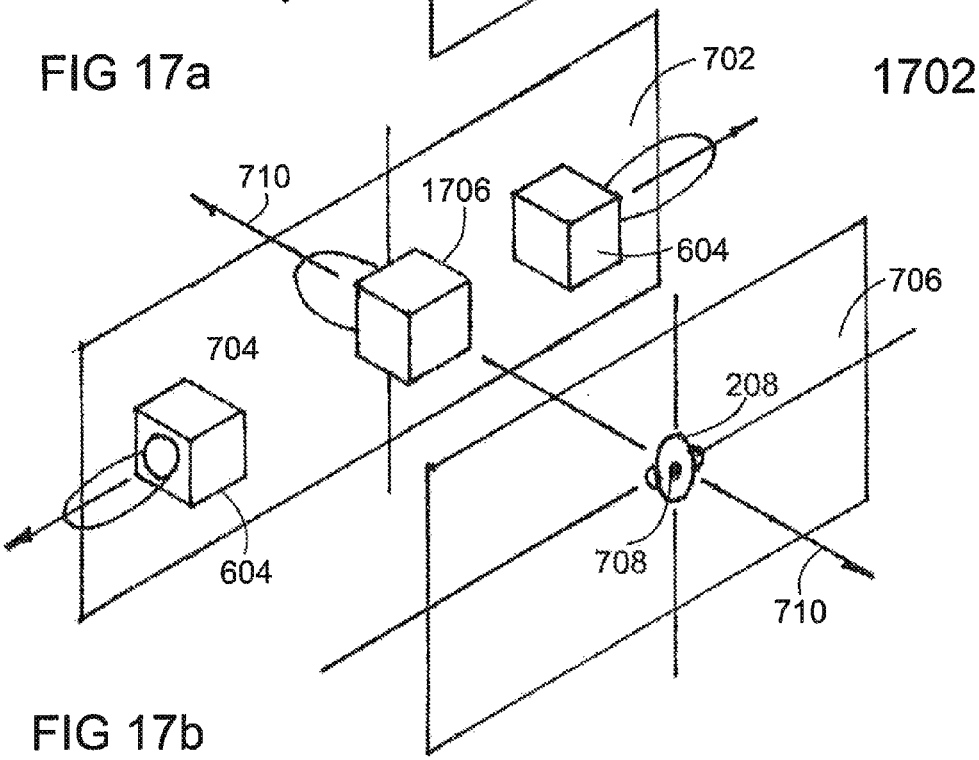

Ignoring the surround channels, the prior art multi-channel system then is comprised of a set of at least one left, one right, and one center front loudspeaker assemblies wherein the on-axis full range directional acoustic outputs of these assemblies are directed toward the listener plane and essentially perpendicular to listeners ears or are pointed toward the listener center point. Each speaker then is essentially parallel to each other along the loudspeaker system plane with the listener(s) located along the listener plane with the primary listener and at the center of listening axis a shown in FIG. 17*a*. Similarly an RSL multi-channel loudspeaker system 1702 can be shown as a first plane 702 defined by a point 704 designated the main or front loudspeaker system center and a second plane 706 defined by a point 708 designated as the listener center. A line 710 normal to said planes and passing through said center points wherein this line is designated the primary listening axis is shown in FIG. 17*b*. The RSL system then is comprised of a set of at least one left, one right, and one center 1706 front loudspeaker assemblies wherein the on-axis full range directional acoustic output of the center fill assembly 1706 is directed substantially rearward of system center and essentially perpendicular to listeners ears, that is, at a nominal horizontal angle of −90 degrees along said first plane with the primary listener located at said listener center point at the center of said listening axis.

FIG. 18*a* shows a top view of a basic First Order RSL speaker system 1800 comprised of a center-fill array 1706 that is located between the main left and right loudspeakers. In multi-channel or home theater applications the center fill speaker assembly 1706 may also be located between the left and right surround speakers as the center surround speaker in a 6.1 channel system. An example of a basic First Order Center-fill speaker assembly is shown in FIG. 18*c*. The speaker assembly 1802 includes an enclosure having a plurality of sides and a full range acoustic transducer/array 908 mounted to a first side. The full range acoustic transducer and/or transducer array operate within a frequency range that can reproduce both Interaural intensity (ID) and time (ITD) sounds the human sense of hearing uses to localize sound sources and a speaker wire connector terminal 906 mounted to a first side. The speaker assembly optionally includes a bass reflex port 910 provided on the first side 1810.

The basic center-fill design will exhibit a high frequency fall off and will be localized by listeners due to the high ITD cues generated by both the full range drivers and enclosure as described previously. FIG. 18*b* shows a generalized top view of an RSL speaker system 1810 with a Second Order RSL Center Fill speaker assembly 1812 that is enhanced with the previously mentioned solutions that improve high frequency response and reduce ITD cues. The direction of the on-axis full range acoustic output of the speaker lines 402 are shown along with their associated polar lobes and the high frequency acoustic driver or tweeters/super tweeters 1302/1304.

As shown in FIG. 18*b* the enhanced center-fill speaker assembly is comprised of a cabinet or enclosure having a plurality of sides, a full range acoustic transducer/array 908 mounted to a first side, a set of speaker wire input terminals 906 mounted to the first side, and a pair of high frequency acoustic drivers or tweeters/super tweeters 1302/1304 mounted to a second and third side adjacent to the first side at acute angles to the first side. In this case the optional bass reflex port(s) 910 may be provided on the first, second and or third sides a speaker wire connector terminal 906 mounted on the first side may be mounted optionally on the second or third side. These speaker assemblies may be of any shape including cylindrically-shaped.

The enhanced center-fill speaker is also comprised of an ITD diffuser 1202 as shown in FIG. 18*d* wherein the diffuser is located in such a way as to collect and redirect this energy away from the listener 208 to control ITD cues. Ideally, the ITD diffuser 1202 is acoustically isolated from the primary baffle/cabinet 10 in order to avoid primary cabinet vibrations from being coupled to and then transmitted by the ITD diffuser.

Both the basic and enhanced RSL center-fill speakers will be sensitive to standing waves and/or early reflections when placed close to the wall of the listening space. This may cause a number of sonic distortions as well as provide a signature due to the immediate reflections that may occur. The typical solution of providing some distance between the center-fill assembly and the wall may not be possible for various reasons.

A solution then is to minimize standing waves and reflections by providing two full range acoustic drivers that are oriented at a sufficient angle as shown in FIGS. 19*a* and 19*b*. A First Order solution is shown in FIG. 19*a* with a Second Order solution shown in FIG. 19*b*. The First Order assembly 1902 is comprised of an enclosure 1904, two full range acoustic drivers or driver arrays 908 wherein the driver array is comprised of a set of specially constructed drivers operating in specific frequency ranges, a speaker wire terminal, and optional bass reflex ports that may be mounted on multiple sides as shown in FIG. 19*c*. The Second Order assembly 1910 is shown in FIG. 19*d* with the addition of the secondary baffle or diffuser 1202 as shown. In both cases super tweeters may be needed to provide an extended high frequency response.

Figure 20A:
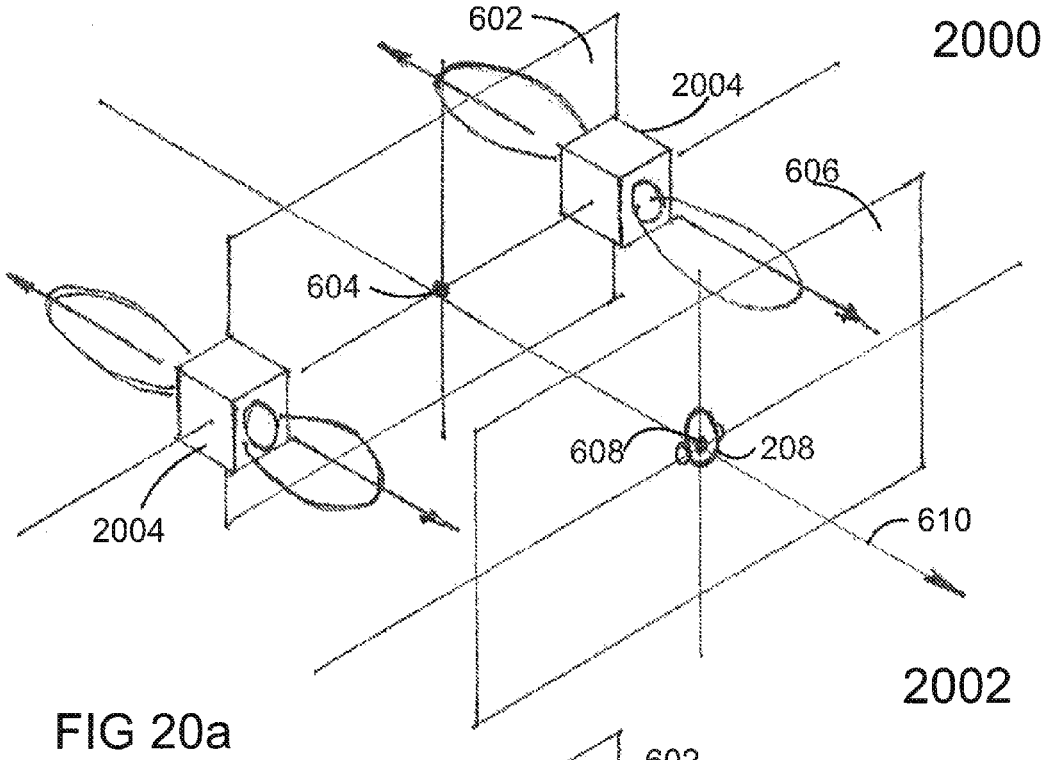
FIGS. 20*a* and 20*b* shows a comparison of the relationship of bipolar loudspeakers full range directional acoustic output to listeners in space for conventional loudspeakers and RSL systems.
Figure 20B:
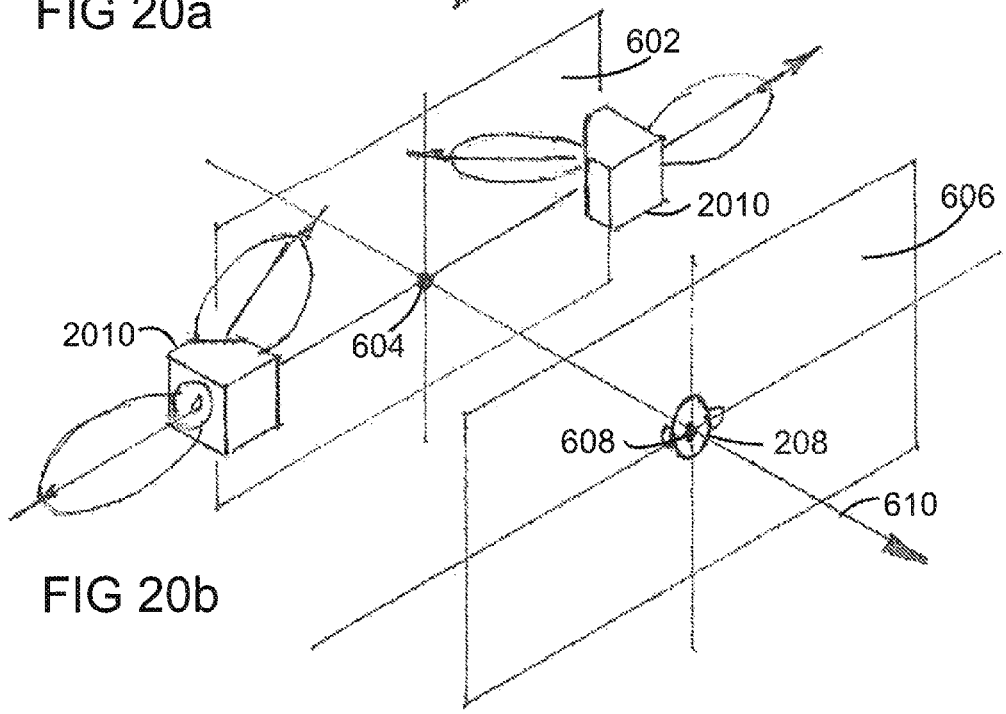

The Main and Center-fill functions may be combined into a single cabinet, thus simplifying the installation as well as providing several additional sonic benefits. This third design is referred to as a Bimodal Bipole RSL since this system is essentially a Bipole that radiates full range sound in two directions with the full range acoustic outputs in phase. Unlike a conventional Bipole 2004, the Bimodal Bipole's opposing full range sound is radiated at an angle of less than 180 degrees therein the term bimodal. The fundamental difference between prior art loudspeaker systems and an RSL system is the relationship between the listener and the direction of the on-axis full range acoustic output of the speakers. As shown in FIG. 20*a* the conventional Bipole 2004 functions only as a main L/R speaker since sound from the forward firing drivers arrive on the first wave initiating perception with the later arriving rearward firing drivers output adding to the early reflections. By contrast, the Bimodal Bipole RSL on-axis full range acoustic output is oriented essentially parallel to the listener's ears as shown in FIG. 20*b*.

As previously seen, loudspeaker systems can be defined as a set of planes along which speakers, their full range directional acoustic outputs, and listeners are located in space. In FIG. 20*a* the conventional bipolar loudspeaker system 2000 can be shown located on a first plane 602 defined by a point 604 designated the main or front loudspeaker system center and a second plane 606 defined by a point 608 designated as the listener center. A line 610 normal to said planes is designated the primary listening axis.

Similarly a Bipolar Bipole RSL system 2002 can be shown as a first plane 602 defined by a point 604 designated the main or front loudspeaker system center and a second plane 606 defined by a point 608 designated as the listener center. A line 610 normal to said planes is designated the primary listening axis is shown in FIG. 20*b*. The Bipolar Bipole RSL system then is comprised of a set of at least one left and one right front loudspeaker assemblies wherein a first on-axis full range directional acoustic output of the speaker assembly is directed substantially outward of system center and essentially perpendicular to listener's ears. And wherein a second on-axis full range directional acoustic output of said speaker is directed substantially inward toward system center and rotated a nominal −45 degrees rearward of system center and still essentially perpendicular to listener's ears. This rearward rotation is critical to avoid the human sense of hearing from localizing the loudspeaker.

FIG. 21*a* shows a top view of a set of basic First Order Bipolar Bipole RSL speaker arrays 2010 used in a two channel stereophonic system 2100. In this application both the inward 2112 and 2114 arrays and outward 2116 and 2118 arrays are fed corresponding left 2104 and right 2106 signals. FIG. 21*b* shows a set of basic First Order Bipolar Bipole RSL speaker arrays used in a multi-channel or home theater system 2130. In this case the inward 2112 and 2114 arrays are fed identical center signals 2120 and the outward 2116 and 2118 arrays are fed corresponding left 2104 and right 2106 signals.

A basic First Order Bipolar Bipole RSL speaker design is detailed in FIG. 21*c* showing the location of the outer or main left/right full range acoustic driver 2108 mounted to a first side along with the optional bass reflex port 910 as well as the side facing the listener plane 2122. FIG. 21*d* shows the location of the inner or center fill full range acoustic driver 2110 and the optional bass reflex port 910 mounted to the second side, and the speaker wire input terminal 906 mounted to a third side. The side facing the listener plane is also shown for orientation clarity.

Figure 22A:
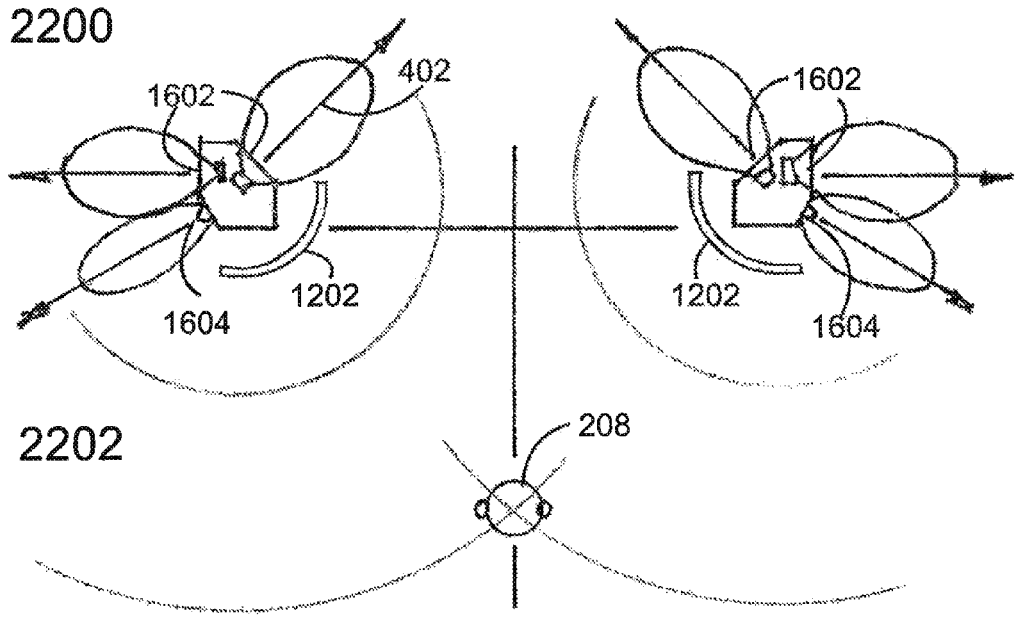
FIG. 22*a* shows an enhanced second order RSL Bimodal Bipolar system in accordance with various embodiments.

The basic First Order Bipolar Bipole RSL speaker design is characterized by a high frequency fall off and will be localized to an extent by listeners due to the high ITD cues generated by both the full range drivers and enclosure as described previously. FIG. 22*a* shows a generalized top view of an RSL speaker system 2200 with a Second Order Bipolar Bipole RSL speaker assembly that is enhanced with the previously mentioned solutions that improve high frequency response and reduce ITD cues. The direction of the on-axis full range acoustic output of the speaker are shown as vector lines 402 along with their associated polar lobes for both the full range acoustic transducers 1602 and the high frequency acoustic driver or tweeter 1604.

Figures 22B, 22C:
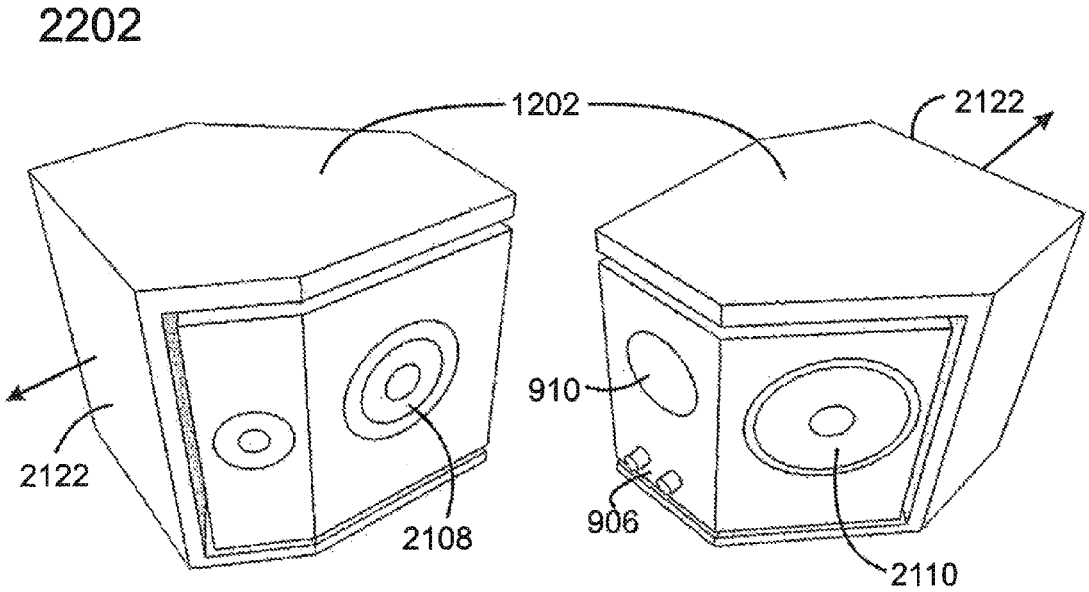
FIG. 22*b* shows the Main R/L or outward facing side of a second order Bimodal Bipole assembly and FIG. 22*c* shows the center-fill or inward facing side of a second order Bimodal Bipolar assembly.

One view of the enhanced Bipolar Bipole RSL speaker assembly 2202 is shown in FIG. 22*b* and shows the location of the outer or main left/right full range acoustic driver 2108 mounted to a first side along with the optional bass reflex port 910 as well as the side facing the listener plane 2122. The secondary baffle or ITD diffuser 1202 is also shown. A second view of the enhanced Bipolar Bipole RSL speaker assembly 2202 is shown in FIG. 22*c* and shows the location of the inner or center fill full range acoustic driver 2110 and the optional bass reflex port 910 mounted to the second side, and the speaker wire input terminal 906 mounted to a third side. For orientation clarity the side facing the listener plane 2122 is also shown. The secondary baffle or ITD diffuser 1202 is also shown. These speaker assemblies may be of any shape including cylindrically-shaped.

Figure 23A:
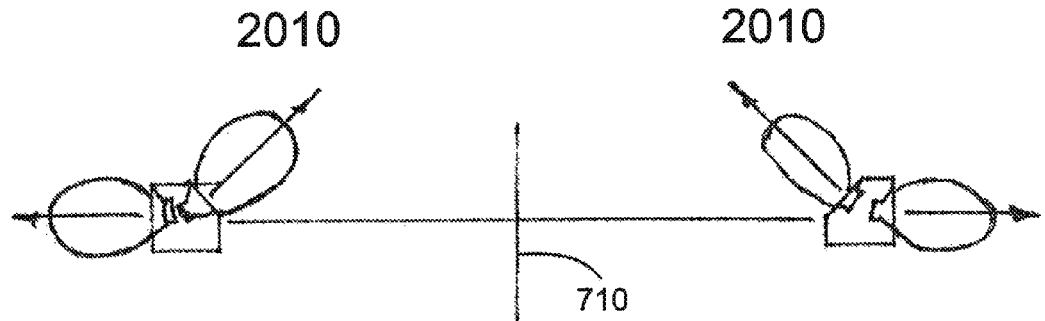
FIG. 23*a*-23*c* demonstrates the ability to adjust the soundstage by rotating an Bimodal Bipole RSL array in accordance with various embodiments.
Figure 23B:
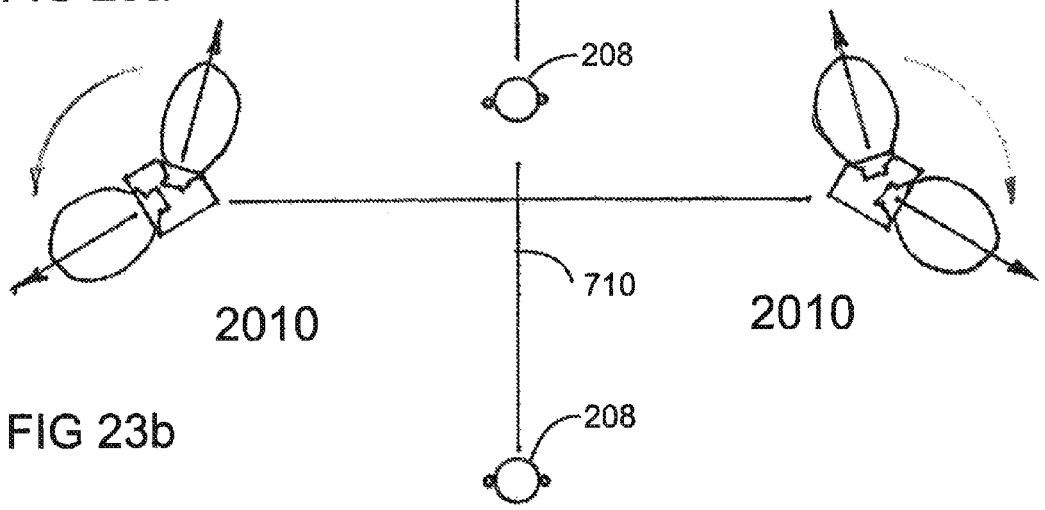
Figure 23C:
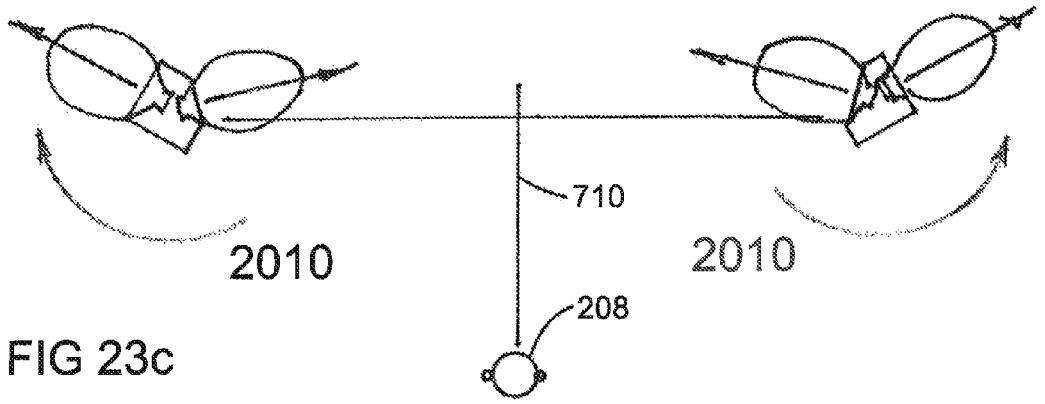

Since the Bimodal bipole design includes both center and R/L information, there is an opportunity to adjust the width of the sound stage by rotating the array. A top view of a normally positioned bimodal bipole RSL system is shown in FIG. 23*a* with the outer or main L/R arrays first on-axis full range directional acoustic output of the speaker assemblies 2010 are directed substantially outward of system center. And wherein a second on-axis full range directional acoustic output of said speaker is directed substantially inward toward system center and rotated a nominal −45 degrees rearward of system center. Rotating the arrays 2010 away from the center listener will widen the soundstage as shown in FIG. 23*b* while rotating the arrays 2010 toward the center listener will provide a more center weighted soundstage as shown in FIG. 23*c*.

With the bimodal Bipole design, a very wide soundstage is produced that will accommodate several listeners in typical home seating fashion. The Bimodal bipole provides the opportunity to vary the perceived width of the sound stage allowing the listeners to optimize for specific recordings, the number of listeners and their preferences. This freedom of seating while maintaining a high-quality listening experience is not available using conventional two-channel stereophonic systems.

Figure 24:
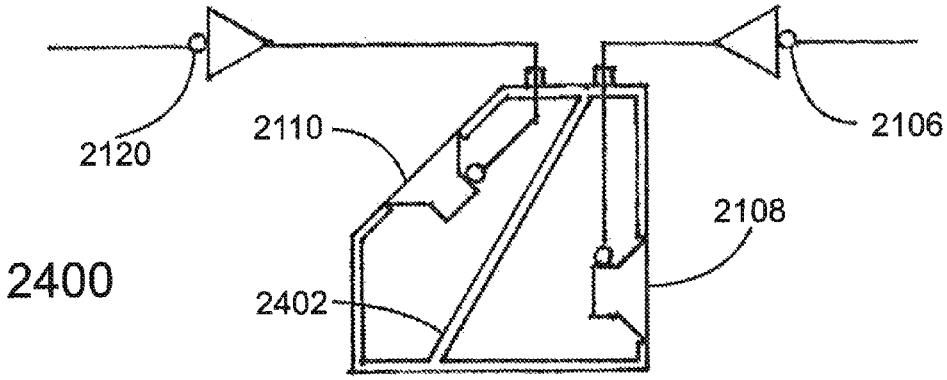
FIG. 24 shows the inclusion of an isolation baffle in a first order Bimodal Bipole speaker in accordance with various embodiments.

FIG. 24 shows a bimodal bipole speaker assembly 2400 including an interior baffle 2402 that divides the enclosure into two volumes. This allows two different audio signals, for example a main channel 2106 and a center fill channel 2120, to be presented to each speaker 2108 and 2110 independently. Thus, the acoustical output of each speaker is not influenced by differing signals presented to the other speaker in the enclosure. This is particularly applicable in home theater applications where a main R/L channel will be sent to the outer array 2108, while the center channel is sent to the inner center fill array 2110. This baffle 2402 will ensure both acoustic signals are accurately reproduced and not mixed.

Figure 25:
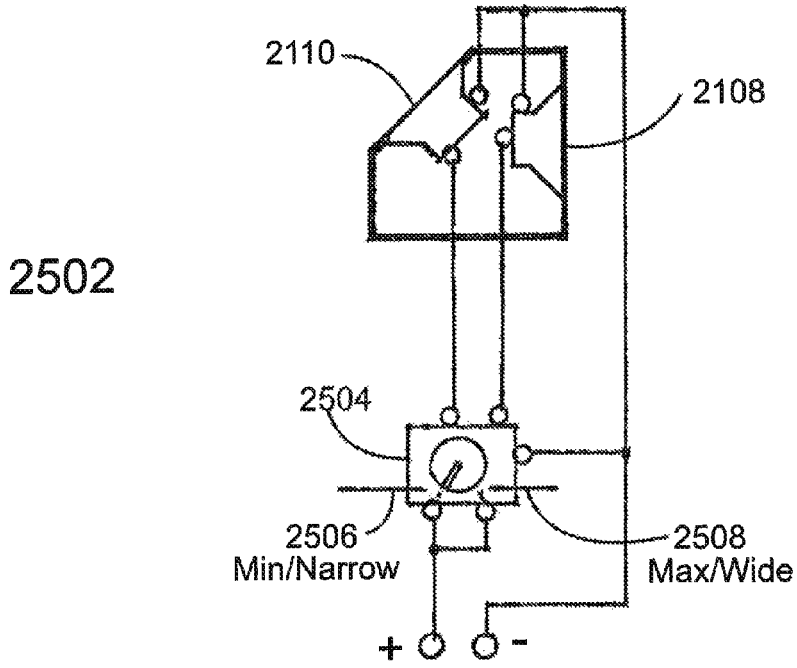
FIG. 25 shows an Bimodal Bipole loudspeaker assembly with an L-Pad attenuator to allow adjustment of intensity levels allowing center level weighting to be varied in accordance with various embodiments.

FIG. 25 shows a Bimodal bipole speaker assembly 2502 where an L-Pad attenuator 2504 is provided to vary the amplitude of the two loudspeakers/arrays. In two-channel stereo applications, this control will allow adjustment of the balance between the center fill driver array 2110 and the Main right/left driver array 2108 changing the perceived width of the sound stage. When set in the minimum or narrow position 2506 the center fill array 2110 will receive a greater amplitude center signal thereby decreasing the perceived width of the soundstage while setting the L-pad to the maximum or wide position 2508 the outer or main L/R driver array 2108 will receive a higher amplitude main L/R signal thereby increasing the perceived width of the soundstage. This control enables some of the benefits of a three channel system (left/center/right) derived from just two channels. Unexpectedly, a similar result will occur with a monaural signal applied to each driver/array further reducing cost.

RSL arrays require no unique signals, so normal amplifiers may be used. However, in some embodiments it may be helpful to have controls that enable RSL arrays to be used to their full advantage. These controls present unique opportunities to tailor the signals presented to the RSL to compensate for problematic recordings or make adjustments to suit individual preferences, as well as enhance RSL performance, While the RSL array can utilize any conventional recording, the RSL loudspeaker is able to produce an accurate soundstage with a monaural signal. Sufficient ambient information is normally recorded with monaural microphones such that two channels representing left and right information may not be necessary. The ability to switch to monaural operation is useful because it can reduce complexity of more exuberantly engineered recordings and allow for a more believable soundstage. Although the mono switch has been eliminated in many amplifiers, its inclusion may be helpful for RSL systems. It may be possible that low-cost RSL systems will not use stereo signals in order to reduce the overall cost of a system by eliminating a channel of amplification.

A high-frequency tone control or equalizer is helpful to allow sufficient HF response, which may be limited due to the normal off-axis roll off of HF drivers in some RSL array designs. These controls are also used to reduce HF noise, especially in FM radio, off-balance or bright recordings, or to reduce the prominence of instruments with HF content placed too far outside the soundstage.

Systems that use a Center Fill or Bimodal bipole array may take advantage of varying the width of the perceived soundstage. It is helpful in multi-listener situations to be able to increase or decrease the level of the Main and Center Fill arrays. This allows listeners in the outside seating positions to enjoy a more natural soundstage by increasing the Center-Fill level and reducing the Main array level. In the reverse situation, decreasing the fill level and increasing the Main array level will widen the soundstage. The soundstage can vary by recording, so in these situations a width control is helpful to produce a more consistent soundstage independent of the recording. Implementation of the width control can range from L-Pads as shown in FIG. 25 to separate amplifiers that allow electronic control at the preamp as would be understood by one skilled in the art.

Figure 26:
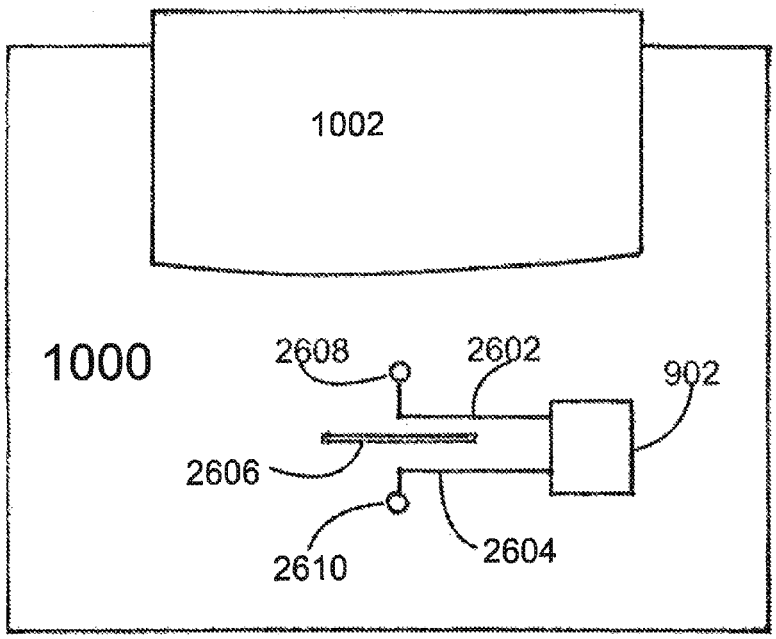
FIG. 26 shows a RSL recording setup in accordance with various embodiments.

FIG. 26 shows a RSL microphone setup that allows live surround recording with just two channels, the direct or main channel 2602 and an ambience or surround channel 2604. In some embodiments, the direct channel 2602 and the ambience channel 2604 are separated by a baffle 2606. The direct or main microphone 2608 picks up the direct sound of the performance (e.g., orchestra 1002) while the ambience or surround microphone 2610 picks up the reflected sound of the hall. Recording experience and listener preference will establish desirable setups, but the RSL recording concept will result in more realistic recordings with significantly fewer channels than conventional solutions.

Figure 27A:
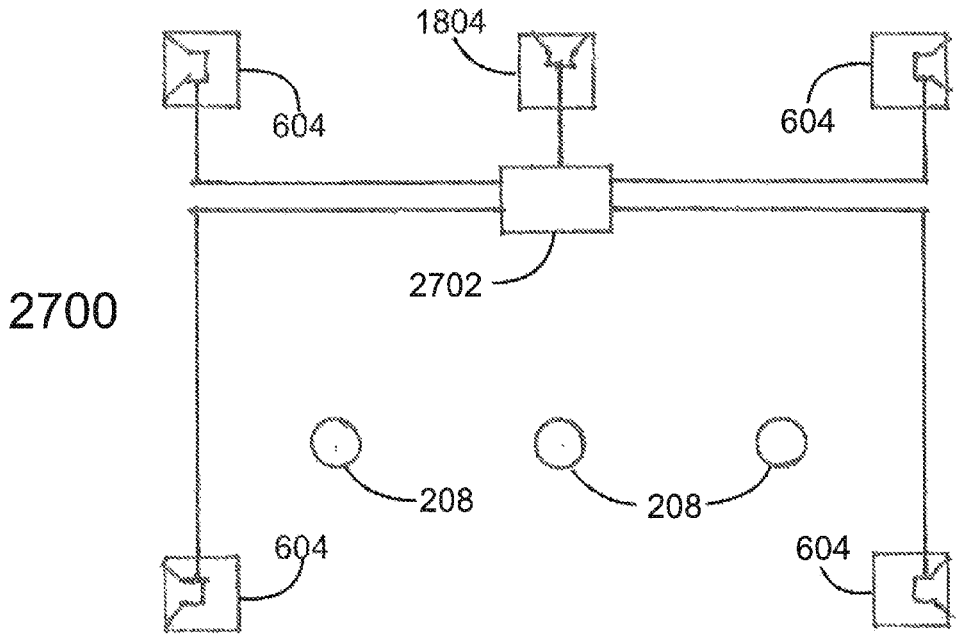
FIGS. 27*a* and 27*b* shows first order 5.1 and 7.1 surround sound RSL setups respectively in accordance with various embodiments.
Figure 27B:
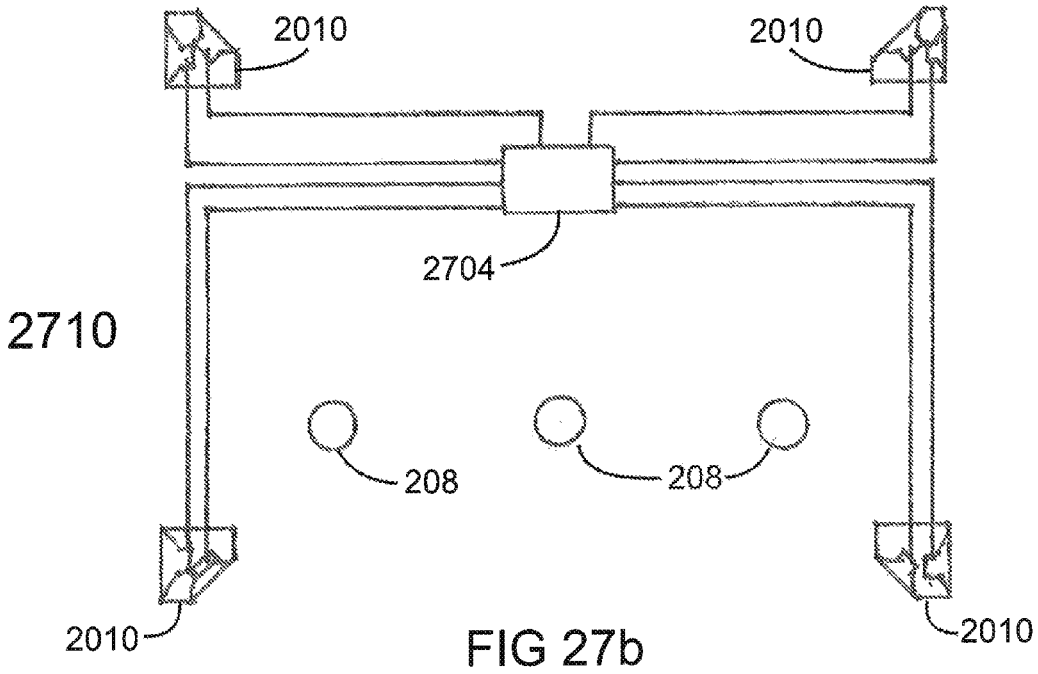

The advent of surround sound, or multi-channel systems has expanded the use of home audio to include video forms like movies and television utilizing five or more distinct channels. Rear surround channels and speakers are added in addition to center channels to overcome the loss of the phantom image for those not seated on the centerline. As shown in FIG. 27*a*. First Order RSL arrays 604 and 1804 may be advantageously arranged to produce a 5.1 surround sound system 2700 The latest surround systems 2710 add more channels and FIG. 27*b* shows a 7.1 RSL system utilizing First Order Bimodal bipole arrays 2010. In some embodiments, diffusers may be positioned near the RSL arrays to provide Second Order RSL arrays. The minimum basic configuration could be comprised of at least four Main/Surround Arrays while four bimodal bipole arrays would be ideal allowing for a more flexible center image as well as reduce the number of cabinets for a full 7.1 system from seven to four. Alternately, front and rear Main/Surround arrays 604 could be augmented by First or Second Order Center Fill arrays 1804.

Current multi-channel amplifiers are compatible with RSL technology without modification; however, new features may improve their ability to increase realism. Existing amplifiers typically feature adjustable center channel volume controls. In systems utilizing Center-Fill RSL speakers these controls may be used to allow for width adjustments without modification as described above. As in the case of two-channel stereo, the use of a mono switch may be advantageous in surround sound applications to reduce complexity of over-engineered audio tracks. The results will retain sufficient localization information without the distracting errant sounds coming from inappropriate places. Thus, RSL-specific AV amplifiers that integrate mono switches as well as dual center amplifiers with specifically dedicated controls for width are advantageous.

Conventional video monitors with integral sound capabilities are used in both far field listening applications like televisions and near field listening applications like desktop computers. These acoustic drivers may be powered by discrete amplified channels such as monaural, right, left, center and even surround signals. As previously noted the fundamental difference between current loudspeaker systems and an RSL system is the relationship between the listener and the direction of the on-axis full range acoustic output of the speakers. Of course this holds true for speaker systems found in video monitors as well.

Figure 28A:
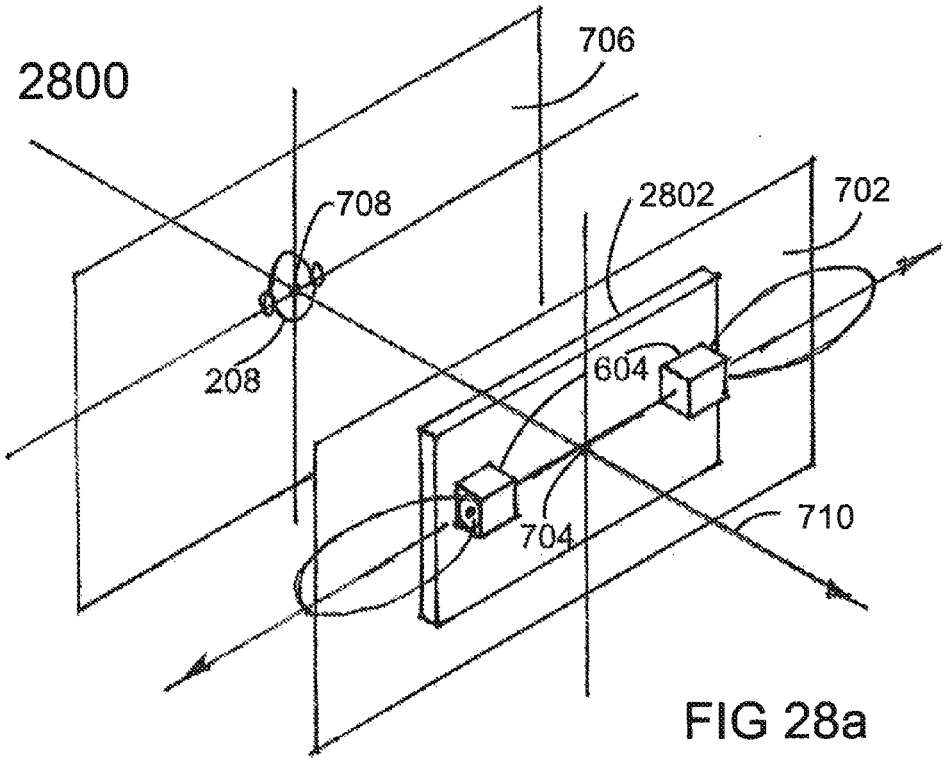
FIGS. 28*a* and 28*b* shows the relationship of loudspeakers full range directional acoustic output to listeners in space for a video monitor system in accordance with various embodiments.

For video listeners the fact that the video monitor is centrally located will render a video monitor integrated sound system, be it stereophonic or multi-channel, to be perceived by listeners as a monophonic system. These systems will be localized at the monitor as described in Pineau's back-to-back system even if there are a myriad of signals and acoustic source directions. This is due to the fact that video monitors are normally placed essentially at the center point of the loudspeaker plane as shown in FIG. 28*a*. Stereo sound is readily localized at the video monitor and listeners perceive sound as coming from the video screen as our visual sense assists in localization. The fact that off-axis listeners will localize the sound at the television/video monitor is actually a benefit since multiple listeners can hear all the audio information as opposed to current art stereo where off center listeners hear a right or left channel weighting. Sound systems integrated into video monitors are challenged by the relatively narrow separation of drivers available as well as a thin cabinet that make providing full range sound difficult. As a result conventional flat panel speaker systems normally cannot provide an accurate sense of space nor are they able to provide full range sound capability. Therefore video monitor sound systems are normally designed as secondary sound sources that assume a primary system will be utilized for more demanding applications like home theater/multi-channel sound.

One solution to improved sound for flat panel television is the sound bar which is a monitor wide accessory speaker that provides amplified stereo or multi-channel sound. While sound bar solutions provide better sound they cannot escape the fact that they are centrally located, suffer from narrow left/right acoustic driver separation, and therein provide a high acoustic signature making them readily localized by listeners.

The Bose Video Wave television system introduced in 2010 is a unique device essentially integrating a sound bar and sub woofer system into a flat panel video monitor. Sixteen acoustic drivers are integrated into the monitor and are powered by proprietary electronics that provide additional signal processing. This system features four driver arrays, a left/center/right driver array, a center tweeter, a left/right tweeter system and a bass module. The left/center/right array is comprised of seven speakers located at the top of the unit and canted vertically up toward the wall at a 45 degree angle and driven by right, center, and left signals. The center tweeter array is located at the center of the bottom of the display and canted at a 45 degree angle toward the front wall. These three arrays result in a high signature center weighted sound stage that, like the reflective designs discussed previously, is current art allowing the listeners to localize these arrays. The fourth array is a pair of horn tweeters one facing right and the other left and directed horizontally outward toward the side wall. The outward firing tweeters provide some sound field expansion but only for the primary listener on the centerline as is the case with the back to back solution patented by Pineau. But as in the Pineau case listeners off center will localize these tweeters at the video monitor and not gain the same sense of expansion.

As will be seen, an RSL video monitor loudspeaker array will produce a much more realistic sonic image at a significantly lower cost and complexity.

Desktop computers typically feature a single speaker located in a separate CPU that is not intended to function as a sound system to reproduce music and video sound tracks. Similar to the stereo television arrangement discussed above, computer sound systems may utilize either separate speakers systems or, less likely, speakers integrated into the computer monitor. The speakers are listened to in near field mode, that is, very close to the speakers normally providing limited opportunity to generate any perception of width. A good example is the Apple iMac computer with integrated sound that is provided by horn loaded acoustic drivers that are vented along the bottom edge, perpendicular to the viewing screen and directed downward. Stereo sound is readily localized at the base of the computer but listeners perceive sound coming from the video screen as our visual sense assists in localization.

In general, video monitor loudspeaker systems can also be defined as a set of planes along which speakers, their full range directional acoustic outputs, and listeners are located in space. FIG. 28*a* shows an RSL video monitor loudspeaker system 2800 located on a first plane 702 defined by a point 704 designated the main or front loudspeaker system center and a second plane 706 defined by a point 708 designated as the listener center. A line 710 normal to said planes is designated the primary listening axis. The video monitor RSL system then is comprised of a video monitor 2802, a set of at least one left and one right front loudspeaker assemblies 604 wherein a first on-axis full range directional acoustic output of the speaker assembly is directed substantially outward of system center and essentially perpendicular to listener's ears. For clarity, FIG. 28*b* shows a top view of the RSL video monitor loudspeaker system 2800.

Figure 28B:
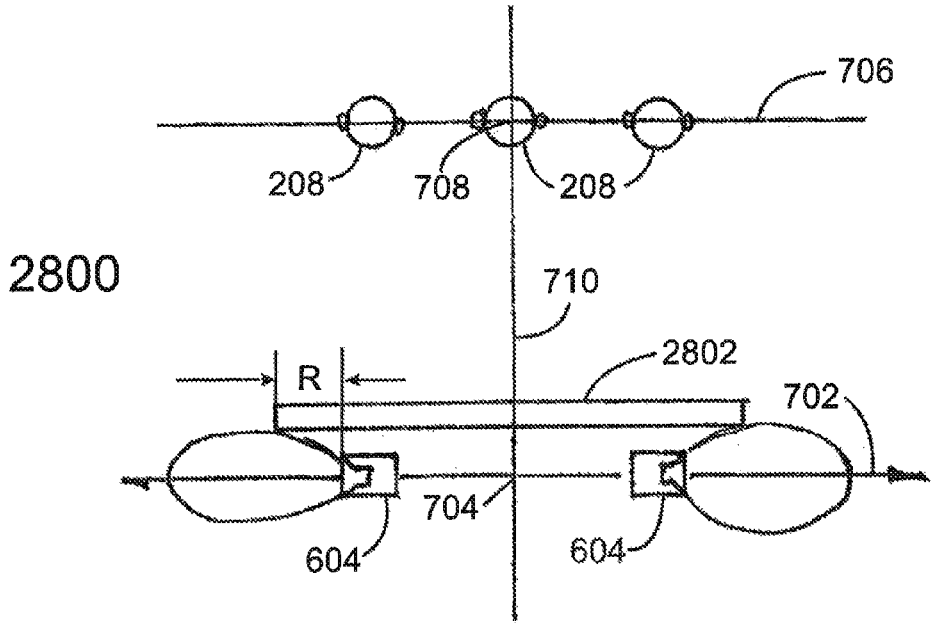

In flat panel embodiments especially the monitor itself can be utilized as an ITD diffuser, for example by recessing the full range driver inward, toward center of the horizontal edge of the panel as shown in FIG. 28*b*. While a more obvious design may be to locate the acoustic driver on the edge of the monitor or even outward, diffraction of sound will generate a significant time signature allowing the sense of hearing to localize the speaker. The simple step of recessing the driver improves the design from a first order RSL to a very effective second order RSL. The actual recess dimension "R" 2804 will be determined by taking into account the directivity of the full range driver/array the distance the driver/array is mounted from the video monitor back panel, the azimuth angle of the driver/array as well as other factors that impact sound quality and localization. As indicated in FIGS. 29*a-c*, integrating the loudspeakers into the monitor instead of providing separate stand alone speakers is beneficial since this method controls the location of the speakers and reducing set up errors on the part of users.

Figure 29A:
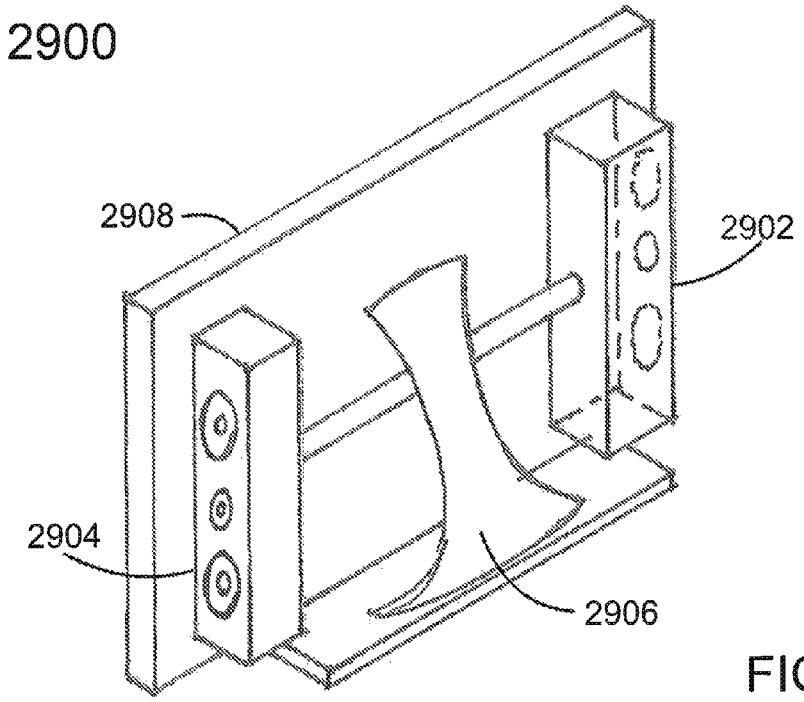
FIGS. 29*a*-29*c* show second order RSL speaker placement and options for a video monitor in accordance with various embodiments.
Figure 29B:
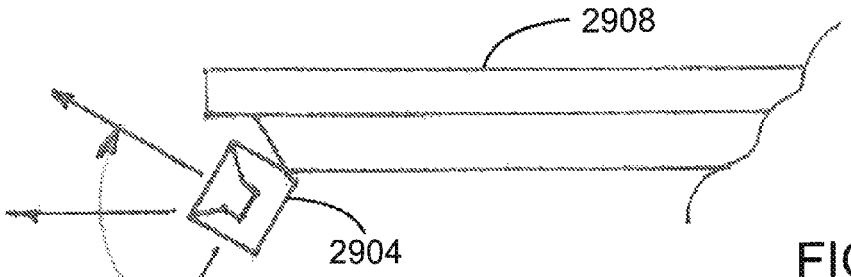
Figure 29C:
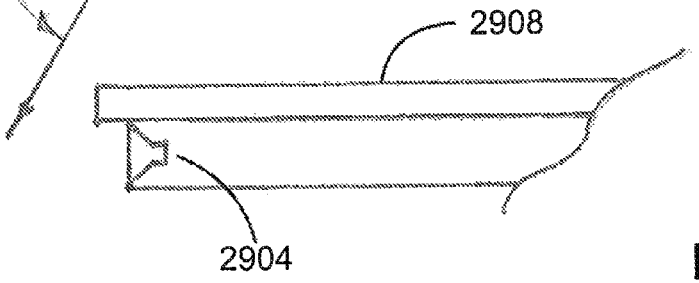

FIG. 29*a* shows a video monitor RSL speaker system 2900 in accordance with various embodiments. This design is scalable from a desktop computer application to the largest television flat panel. The right and left speaker assemblies 2904, 2902 are mounted to a stand 2906 that holds the flat screen 2908 in place. In some embodiments, the speakers 2902, 2904 comprise a RSL mounted to the back of the flat panel 2908. FIG. 29*b* shows the ability of the speaker 2904 to be rotated from front to back through a range of angles, for example +/−45 degrees. FIG. 29*c* shows the speaker 2904 mounted to the body of the video panel 2908. In accordance with various embodiments, the flat panel 2908 doubles as an ITD diffuser making this a Second Order RSL, further improving the intelligibility of the sound by recessing the speaker enclosures from the monitor edge. In accordance with various embodiments performance is improved relative to a First Order RSL. Thus, for a flat panel video monitor there is no practical advantage to utilizing a First Order RSL. A less obvious embodiment operates the speakers 2902, 2904 in monaural mode that reduces cost and improves the experience for listeners located off center because there is no loss of information as there may be when operated with stereo signals (opposite channel information will be muted).

As previously mentioned sound bars that mount above, in front, or underneath video monitors have been a popular way to improve the sound quality of these systems. The RSL systems described above will normally outperform high acoustic signature sound bar systems. In the case of very large screen monitors or users that prefer a more powerful bass response or greater center weighting an RSL sound bar will be attractive. An example of an RSL sound bar system 3000 is shown in FIG. 30*a* wherein a center fill speaker assembly 3002 is added to the right 2904 and left 2902 speaker assemblies.

Figure 30A:
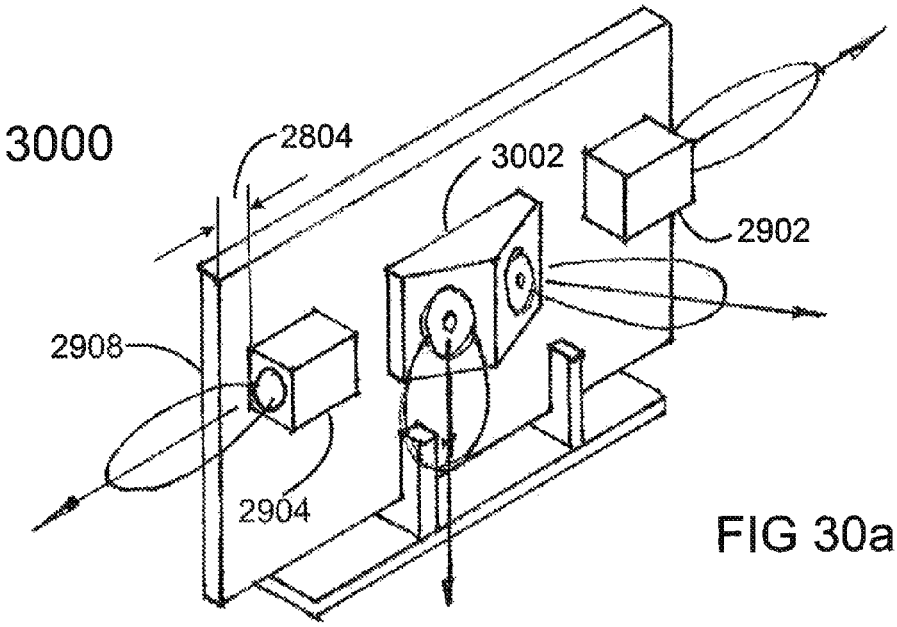
FIGS. 30*a*-30*c* show second order RSL speaker or sound bar options for a video monitor in accordance with various embodiments.
Figure 30B:
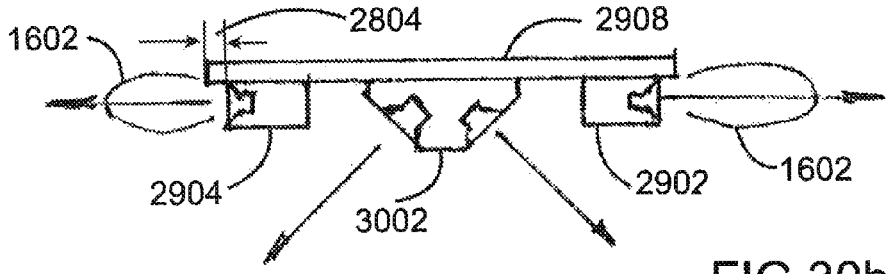

In television applications the monitor may be mounted close to or even on the wall so a solution to minimize standing waves and reflections is helpful as described previously by providing two full range acoustic drivers that are oriented at a sufficient angle as shown in FIGS. 30*a* and 30*b* or even 180 degrees opposed.

Figure 30C:
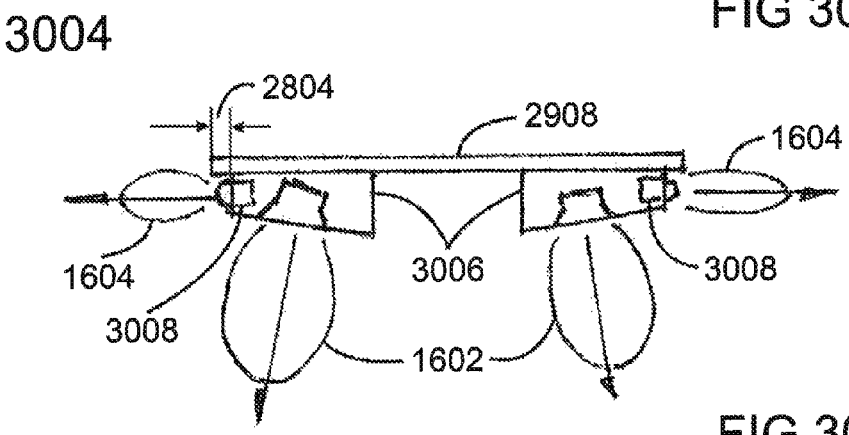

Conventional sound bars are typically constructed in a single cabinet and while this can apply to RSL sound bars as well the importance of an engineered recess dimension "R" 2804 means that single cabinet RSL sound bars will need to be specifically engineered for each video monitor. This problem can be solved by constructing the RSL sound bar in two or three cabinets as shown in FIGS. 30*b* and 30*c*. The center fill assembly is comprised of an enclosure, two full range acoustic drivers and optional bass reflex ports. FIG. 30*b* shows a three speaker solution showing the on-axis directional lobes 1602 of the full range acoustic drivers. FIG. 30*c* shows a two cabinet enhanced system 3004 that include the cabinets 3006 and super tweeters 3008 whose on-axis directional lobes are shown 1604.

Additionally, one skilled in the art would understand that similar arrangements may be adopted for notebook style computers, tablet computers, or other handheld computing devices. Furthermore, home theater type RSL systems may be adapted for use in other venues, for example a commercial cinema or concert venue.

The invention described herein is a novel apparatus and method for creating a realistic impression of sounds reproduced from a wide variety of available recorded material. The invention has been described herein with respect to certain preferred embodiments; it is not intended to limit the invention to any specific details of those preferred embodiments. That is, it should be clear that various modifications and changes may be made to those preferred embodiments without departing from the true spirit and scope of the invention.

What is claimed is:

1. A loudspeaker system, comprising:

a left loudspeaker assembly enclosed in a first cabinet comprising first, second, third, and fourth sides, a full range acoustic driver/array mounted to the first side and facing a left wall of a listening space, the second side forms the rear of the left loudspeaker assembly to which is mounted a set of input terminals and is orthogonal to the first side and faces a front wall of the listening space, the third side is opposite the first side and faces a right side wall of the listening space, and the fourth side forms the front of the left loudspeaker assembly and faces a rear wall of the listening space;

a right loudspeaker assembly enclosed in a second cabinet, separate from the first cabinet, also comprising first, second, third, and fourth sides, a full range acoustic driver/array mounted to the first side of the right loudspeaker assembly and faces the right wall of the listening space, the second side of the right loudspeaker assembly forms the rear of the right loudspeaker assembly to which is mounted a set of input terminals and is orthogonal to the first side of the right loudspeaker assembly and faces the front wall of the listening space, the third side of the right loudspeaker assembly is opposite the first side of the right loudspeaker assembly and faces the left side wall of the listening space, and the fourth side of the right loudspeaker assembly forms the front of the right loudspeaker assembly and faces the rear wall of the listening space;

wherein the full range on-axis directional acoustic output of each loudspeaker assembly is directed outward toward the left and right side walls respectively of the listening space at an azimuth of approximately 180+/−45 degrees;

wherein each full range acoustic driver/array can reproduce the range of frequencies that the human sense of hearing uses to localize sound sources and;

wherein no acoustic output of the loud speaker system is directed directly toward the listening space; and wherein no acoustic output of the loudspeaker system is directed vertically, up or down, in the listening space; and wherein the first sides of the left and right loud speaker assemblies are separated by a distance of at least approximately 1.0 feet.

2. The loudspeaker system of claim 1 wherein each loudspeaker assembly comprises a bass reflex port provided on at least one of the first side and the second side.

3. The loudspeaker system of claim 1 wherein each of the left and right loud speaker assemblies comprises at least one tweeter speaker or super tweeter speaker mounted at an obtuse angle to the full range acoustic driver/array via a speaker mount to extend a high frequency response.

4. The speaker system of claim 1 wherein each loudspeaker assembly includes a fifth side at an obtuse angle to the first side, and the fifth side connects the first side to the fourth side.

5. The loudspeaker system of claim 4 wherein each loud speaker assembly comprises at least one tweeter speaker or super tweeter speaker mounted onto the fifth side to extend a high frequency response.

6. The loudspeaker system of claim 1 further comprising a diffuser adjacent to at least a portion of each loudspeaker assembly, wherein each diffuser redirects or delays cabinet and transducer induced sound energy in the frequency range of the interaural time differential (ITD) cue, the frequency range being approximately 150 Hz to 2000 Hz.

7. A loudspeaker system of claim 1 wherein each loudspeaker assembly comprises a fifth side connecting the second and third sides and provided at an obtuse angle with respect to the second side, and wherein each loud speaker assembly further comprises a second full range acoustic driver/array mounted on the fifth side;

wherein the full range on-axis directional acoustic output of said second acoustic driver/array is directed inward and toward system center at a nominal oblique azimuth of −45 to −90 degrees; and wherein the first and second full range driver/arrays operate in phase.

8. The loudspeaker system of claim 7 further comprising a bass reflex port provided at least one of the first, second, and fifth side of each loud speaker assembly.

9. The loudspeaker system of claim 7 wherein each loud speaker assembly comprises at least one tweeter speaker or super tweeter speaker mounted at an obtuse angle to the full range acoustic driver/arrays of the first side via a speaker mount to extend the systems high frequency response.

10. The loudspeaker system of claim 7 wherein each loud speaker assembly comprises a sixth side located between the first and fourth sides and at an obtuse angle to the first side and a seventh side located between the third and fourth sides and at an obtuse angle to the fourth side, and wherein each loud speaker includes a tweeter speaker or super tweeter speaker mounted to at least one of sixth and seventh sides.

11. The loudspeaker system of claim 7 further comprising a diffuser adjacent to at least a portion of each loud speaker assembly.

12. The loudspeaker system of claim 11 wherein each diffuser is cylindrically-shaped.

13. The loudspeaker system of claim 7 wherein each loud speaker assembly comprises an interior baffle that divides each such assembly into two volumes.

14. The loudspeaker system of claim 7 wherein each loud speaker assembly comprises an attenuator to vary the intensity of the each full range acoustic driver/array.

15. A loudspeaker system of claim 1 further comprising:

a center loudspeaker assembly enclosed in a third cabinet, separate from the first and second cabinets, located midway between said left and right loudspeaker assemblies, said center loudspeaker assembly comprising first, second, third, and fourth sides, a full range acoustic driver/array mounted to the first side of the center loud speaker assembly that forms the rear of the center loudspeaker assembly and faces the front wall of the listening space and to which is mounted a set of input terminals, the second side of the center loud speaker assembly faces the right side wall of the listening space, the third side of the center loud speaker assembly is opposite the second side and faces the left side wall of the listening space, and the fourth side of the center loud speaker assembly forms the front of the center loudspeaker assembly and faces the rear wall of the listening space;

wherein full range on-axis directional acoustic output of the acoustic driver/array of the center loudspeaker assembly is directed toward the front wall of the listening space;

wherein the full range acoustic driver/array of the center loudspeaker assembly reproduces the range of frequencies that the human sense of hearing uses to localize sound sources; and wherein no acoustic output of the center loud speaker assembly is directed directly toward the listening space;

wherein no acoustic output of the loudspeaker system is directed vertically, up or down, in the listening space.

16. The speaker assembly of claim 15 further comprising a bass reflex port provided on the first side of the center loudspeaker assembly.

17. The speaker assembly of claim 15 further comprising at least one of a tweeter speaker and super tweeter speaker mounted to a side flanking the first side of the center loudspeaker assembly and at an obtuse angle to said first side.

18. The speaker assembly of claim 15 further comprising a diffuser adjacent to at least a portion of said center loudspeaker assembly, said center diffuser redirects or delays sound energy at least in the audible range of the interaural phase or time (ITD) cues, said range including approximately 150 Hz to 2000 Hz.

19. A system comprising:

a video monitor having a viewing surface and an opposing back surface and;

a left loudspeaker assembly comprising first, second, third, and fourth sides, a full range acoustic driver/array mounted to the first side of the left loudspeaker assembly and facing a left wall of a listening space, the second side of the left loudspeaker assembly forms the rear of the left loudspeaker assembly and faces a front wall of the listening space, the third side of the left loudspeaker assembly is opposite the first side and faces a right side wall of the listening space, and the fourth side of the left loudspeaker assembly and faces the back surface of the video monitor and therein a rear wall of the listening space;

a right loudspeaker assembly comprising first, second, third, and fourth sides, a full range acoustic driver/array mounted to the first side of the right loudspeaker assembly and facing a right wall of a listening space, the second side of the right loudspeaker assembly forms the rear of the right loudspeaker assembly and faces a front wall of the listening space, the third side of the right loudspeaker assembly is opposite the first side and faces a left side wall of the listening space, and the fourth side of the right loudspeaker assembly and faces the back surface of the video monitor and therein a rear wall of the listening space;

wherein each left and right loudspeaker assembly is mounted proximate the back surface of the video monitor, wherein each loudspeaker assembly is recessed from vertical edges of the monitor;

wherein the full range on-axis directional acoustic output of each loudspeaker assembly is directed outward toward the left and right side walls respectively of the listening space at an azimuth of approximately 180+/−45 degrees;

wherein each full range acoustic driver/array can reproduce the range of frequencies that the human sense of hearing uses to localize sound sources;

wherein no acoustic output of the left and right loud speaker assemblies is directed directly toward the listening area in front of the video monitor; and wherein no acoustic output of the left and right loud speaker assemblies is directed vertically, up or down, in the listening space; and wherein the first sides of the left and right loud speaker assemblies are separated by a distance of at least approximately 1.0 feet.

20. The system of claim 19 wherein each loud speaker assembly is mounted proximate the back surface of the video monitor by way of a mounting mechanism that enables each such speaker assembly to be rotated forward or backward.

21. The system of claim 19 further comprising a diffuser adjacent to at least a portion of each loudspeaker assembly, wherein each diffuser redirects or delays cabinet and transducer induced sound energy in the frequency range of the interaural time differential (ITD) cue, said frequency range including approximately 150 Hz to 2000 Hz.

22. The system of claim 19 further comprising a frequency shaping circuit that enables extended high-frequency response or extended low-frequency response.

23. The system of claim 19 further comprising a signal processing logic to electronically widen or center a sonic image produced by the driver/arrays.

24. The system of claim 23 wherein the signal processing logic is further configured to generate a monaural signal to drive the driver/arrays.

25. The loudspeaker system of claim 3 wherein each tweeter or super tweeter is mounted to the corresponding cabinet by way of an angled bracket or a ball and socket mount.

26. The loudspeaker system of claim 3 wherein each tweeter or super tweeter is mounted to the corresponding cabinet by way of a ball and socket mount.

* * * * *